US005873059A

United States Patent [19]

Iijima et al.

[11] Patent Number: 5,873,059

[45] Date of Patent: Feb. 16, 1999

[54] METHOD AND APPARATUS FOR DECODING AND CHANGING THE PITCH OF AN ENCODED SPEECH SIGNAL

[75] Inventors: Kazuyuki Iijima, Saitama; Masayuki Nishiguchi, Kanagawa; Jun Matsumoto, Kanagawa; Shiro Omori, Kanagawa, all of Japan

[73] Assignee: Sony Corporation, Tokyo, Japan

[21] Appl. No.: 736,989

[22] Filed: Oct. 25, 1996

[30] Foreign Application Priority Data

| | | | |
|---|---|---|---|
| Oct. 26, 1995 | [JP] | Japan | 7-279410 |
| Oct. 27, 1995 | [JP] | Japan | 7-280672 |
| Oct. 11, 1996 | [JP] | Japan | 8-270337 |

[51] Int. Cl.[6] ..... G10L 9/00

[52] U.S. Cl. ..... 704/207; 704/205; 704/214

[58] Field of Search ..... 704/200, 201, 704/205, 214, 208, 268, 278, 207

[56] References Cited

U.S. PATENT DOCUMENTS

| | | | |
|---|---|---|---|
| 4,435,832 | 3/1984 | Asada et al. | 381/34 |
| 5,195,166 | 3/1993 | Hardwick et al. | 704/200 |
| 5,216,747 | 6/1993 | Hardwick et al. | 704/200 |
| 5,574,823 | 11/1996 | Hassanein et al. | 704/208 |
| 5,630,012 | 5/1997 | Nishiguchi et al. | 704/208 |
| 5,684,926 | 11/1997 | Huang et al. | 704/268 |

FOREIGN PATENT DOCUMENTS

| | | |
|---|---|---|
| 0279451 | 8/1988 | European Pat. Off. . |
| 0688010 | 12/1995 | European Pat. Off. . |

OTHER PUBLICATIONS

Moorer, *The Use of Linear Prediction of Speech in Computer Music Applications*, Journal of the Audio Engineering Society, vol.27, No. 3 (Mar. 1979).

Quatieri et al., *Shape Invariant Time–Scale and Pitch Modification of Speech*, IEEE Transactions on Signal Processing, vol. 40, No. 3 (Mar. 1992).

*Primary Examiner*—David R. Hudspeth
*Assistant Examiner*—Susan Wieland
*Attorney, Agent, or Firm*—Jay H. Maioli

[57] ABSTRACT

A method and apparatus for reproducing speech signals at a controlled speed and for synthesizing speech includes a dividing unit that divides the input speech into time segments and an encoding unit that discriminates whether each of the speech segments is voiced or unvoiced. Based on the results of the discrimination, the encoding unit performs sinusoidal synthesis and encoding for voiced segments and vector quantization by closed-loop search for an optimum vector using an analysis-by-synthesis method for unvoiced segments in order to find encoded parameters. A period modification unit modifies the length of time associated with each signal segment and calculates a set of modified encoded parameters. In the speech synthesizing unit, encoded speech signal data is output from the encoding unit and pitch data and amplitude data specifying the spectral envelope are sent via a data conversion unit to a waveform synthesis unit, where the number of amplitude data points of the spectral envelope is changed without changing the shape of the spectral envelope, so that the pitch of the signal may be varied without changing its phoneme. A waveform synthesis unit synthesizes the speech waveform based on the converted spectral envelope data and pitch data.

9 Claims, 14 Drawing Sheets

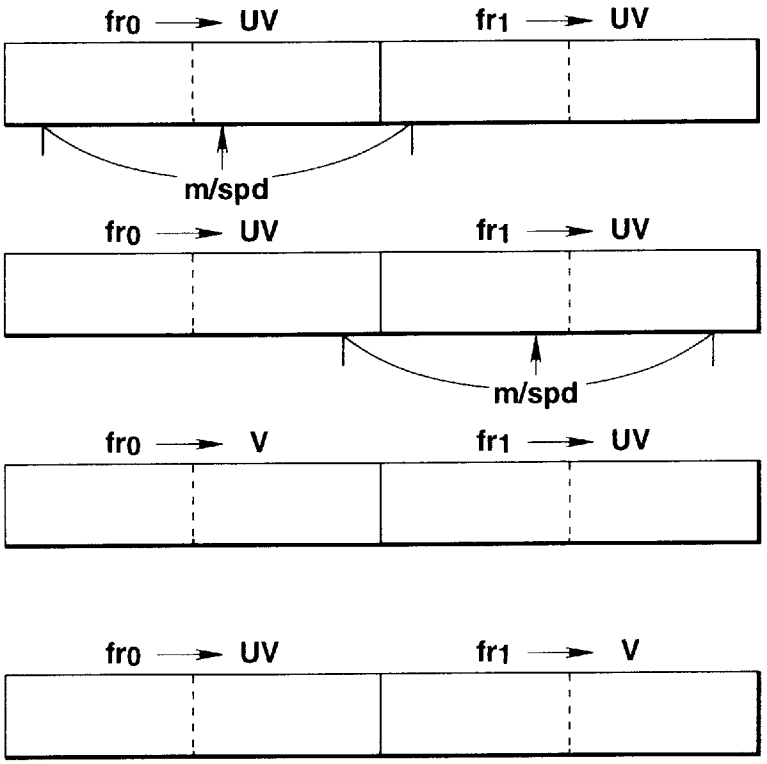
FIG.9(A) FOR UV-UV WITH LEFT<RIGHT
FIG.9(B) FOR UV-UV LEFT≧RIGHT
FIG.9(C) FOR V-UV
FIG.9(D) FOR UV-V

FIG.10(B) COMPRESSION

FIG.10(C) INTERPOLATION

FIG.11(B) INTERPOLATION

FIG.11(C) COMPRESSION

METHOD AND APPARATUS FOR DECODING AND CHANGING THE PITCH OF AN ENCODED SPEECH SIGNAL

BACKGROUND OF THE INVENTION

1. Field of the Invention

This invention relates to a method and apparatus for reproducing speech signals at a controlled speed, and to a method and apparatus for decoding the speech and method and apparatus for synthesizing the speech whereby pitch conversion can be realized by a simplified structure. The present invention also relates to a portable radio terminal device for transmitting and receiving pitch-converted speech signals.

2. Description of the Related Art

There are a variety of encoding methods for encoding an audio signal (including speech and other acoustic signals) for compression by exploiting statistical properties of the signals in the time domain and in the frequency domain, as well as the psychoacoustic characteristics of the human ear. The encoding methods may roughly be classified into time-domain encoding, frequency domain encoding, and analysis/synthesis encoding.

Examples of the high-efficiency encoding of speech signals include sinusoidal analysis encoding, such as harmonic encoding, multi-band excitation (MBE) encoding, sub-band coding (SBC), linear predictive coding (LPC), discrete cosine transform (DCT), modified DCT (MDCT), and fast Fourier transform (FFT).

High-efficiency speech encoding by time-axis processing using, for example, by code excited linear prediction (CELP) encoding, however, involves difficulties in real-time conversation. Voluminous processing operations must be performed to decode the signal for output. Moreover, since speed control is performed in the time domain subsequent to decoding, that method cannot be used for bit rate conversion.

Also, many applications require that decoded speech signals be varied only in pitch, while the phoneme of the signal remains unchanged. With the usual speech decoding methods, the decoded speech has to be pitch-converted using pitch control, thus complicating the design of the encoding/decoding means and raising their cost.

SUMMARY OF THE INVENTION

It is therefore an object of the present invention to provide a method and apparatus for reproducing speech signals, whereby the speed may be adjusted over a wide range while maintaining high sound quality and without changing the phoneme or pitch of the speech.

It is another object of the present invention to provide a method and apparatus for decoding the speech signal and a method and apparatus for synthesizing a speech signal, whereby pitch conversion or pitch control can be achieved using a simplified apparatus.

It is yet another object of the present invention to provide a simplified apparatus, whereby the pitch-converted or pitch-controlled speech signals can be transmitted or received.

According to the speech signal reproducing method of the present invention, the input speech signal is divided on the time axis into predetermined encoding units to produce encoded parameters. These encoded parameters are interpolated to produce modified encoded parameters for desired time points. The speech signal is reproduced based on these modified encoded parameters.

According to the speech signal reproducing apparatus of the present invention, the input speech signal is divided on the time axis in terms of pre-set encoding units to produce encoded parameters which are interpolated to modified encoded parameters for desired time points, and the speech signal is then reproduced based on these modified encoded parameters.

The speech signal is reproduced from encoded block lengths that are different from the block length used to encode the original signal.

According to the speech decoding method and apparatus of the present invention, the fundamental frequency and the number of a pre-set band of harmonics of the input encoded speech data are encoded. Data specifying the amplitude of the spectral components for each input harmonic is interpolated, and this harmonic data is used for modifying the pitch.

The pitch frequency is modified at the time of encoding by dimensional conversion in which the number of harmonics is set at a pre-set value.

The decoder for speech compression may also be used as a speech synthesizer for text speech synthesis. For routine speech pronunciation, clear playback speech is obtained by compression and expansion. Speech synthesis, text synthesis or synthesis from electronically recorded data may be performed using the present invention.

According to the speech signal reproducing method and apparatus of the present invention, an input speech signal is divided into pre-set encoding units on the time axis and encoded in terms of these units in order to find encoded parameters. These encoding parameters are then interpolated to find modified encoded parameters for desired time points. The speech signal is then reproduced based on the modified encoded parameters, so that speed may be adjusted over a wide range while maintaining a high sound quality and without changing the phoneme or pitch.

According to the speech signal reproducing method and apparatus of the present invention, the speech is reproduced with a block length different from that used for encoding, using encoded parameters obtained on dividing the input speech signal on the time axis in terms of pre-set time blocks and on encoding the divided speech signal in terms of encoding blocks. The result is that reproducing speed may be adjusted over a wide range while maintaining a high sound quality and without changing the phoneme or pitch.

According to the speech decoding method and apparatus of the present invention, the fundamental frequency and a pre-set band of harmonics of the input encoded speech data are analyzed and data specifying the amplitude of the spectral component of each input harmonic is interpolated to modify the pitch. The result is that the pitch may be changed in a simplified manner.

The decoder for speech compression may also be used as a speech synthesizer for text speech synthesis. For routine speech pronunciation, clear playback speech is obtained by compression and expansion, whereas, for special speech synthesis, text synthesis or synthesis from stored parameters is used for constituting an efficient speech output system.

According to the portable radio terminal apparatus of the present invention, the pitch-converted or pitch-controlled speech signals can be transmitted or received using a simplified apparatus.

BRIEF DESCRIPTION OF THE DRAWINGS

FIGS. 9A to 9D illustrate the interpolation operation.

FIGS. 10A to 10C illustrate typical operations performed by the unit for calculating modified encoding parameters.

FIGS. 11A to 11C illustrate other typical operations performed by the unit for calculating modified encoding parameters.

DESCRIPTION OF THE PREFERRED EMBODIMENTS

Figure 1:
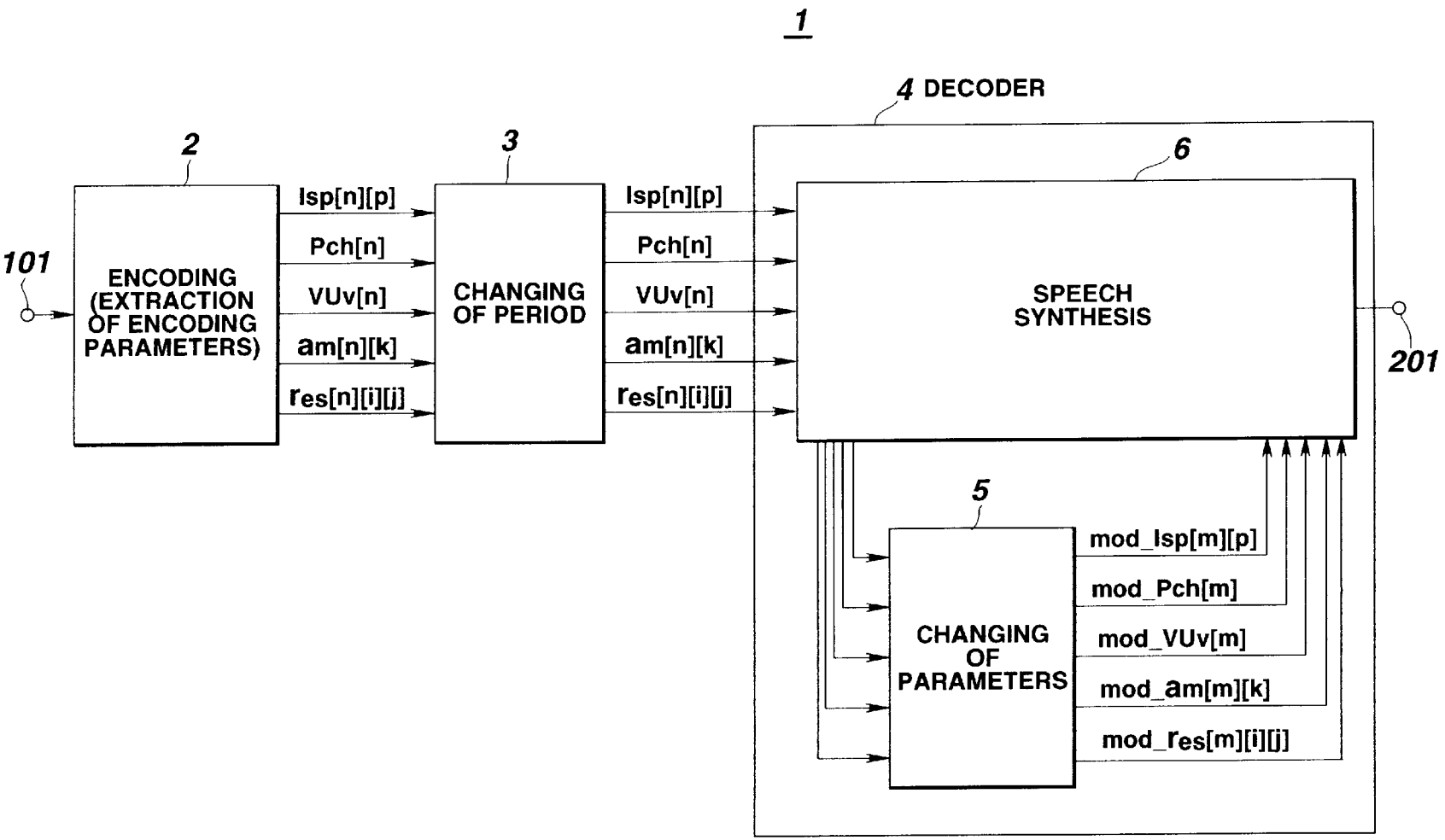
FIG. 1 is a block diagram showing a basic structure of a speech signal reproducing method apparatus for carrying out the speech signal reproducing method according to the present invention.

Referring to the drawings, the speech signal reproducing method and apparatus according to a preferred embodiment of the present invention will be explained. The present embodiment is directed to a speech signal reproducing apparatus 1 for reproducing speech signals based on encoding parameters as found by dividing the input speech signals on the time axis in terms of a pre-set number of frames as encoding units and encoding the divided input speech signals, as shown in FIG. 1.

The speech signal reproducing apparatus 1 includes an encoding unit 2 for encoding the speech signals entering an input terminal 101 in terms of frames as units in order to calculate encoding parameters such as linear prediction encoding (LPC) parameters, line spectrum pair (LSP) parameters, pitch, voiced (V)/unvoiced (UV), or spectral amplitudes Am. These parameters are then passed to a period modification unit 3 for modifying the output period of the encoding parameters along the time axis by compression or expansion. The speech signal reproducing apparatus also includes a decoding unit 4 for interpolating the encoded parameters output by the period modification unit 3 for finding modified encoded parameters at desired time points and for synthesizing speech signals based on the modified encoded parameters. The decoding unit 4 can then output the synthesized speech signals at an output terminal 201.

A method for distinguishing voiced (V) and unvoiced (UV) signals is explained in Japanese Patent Application P07-302129 filed Oct. 26, 1995.

Figure 2:
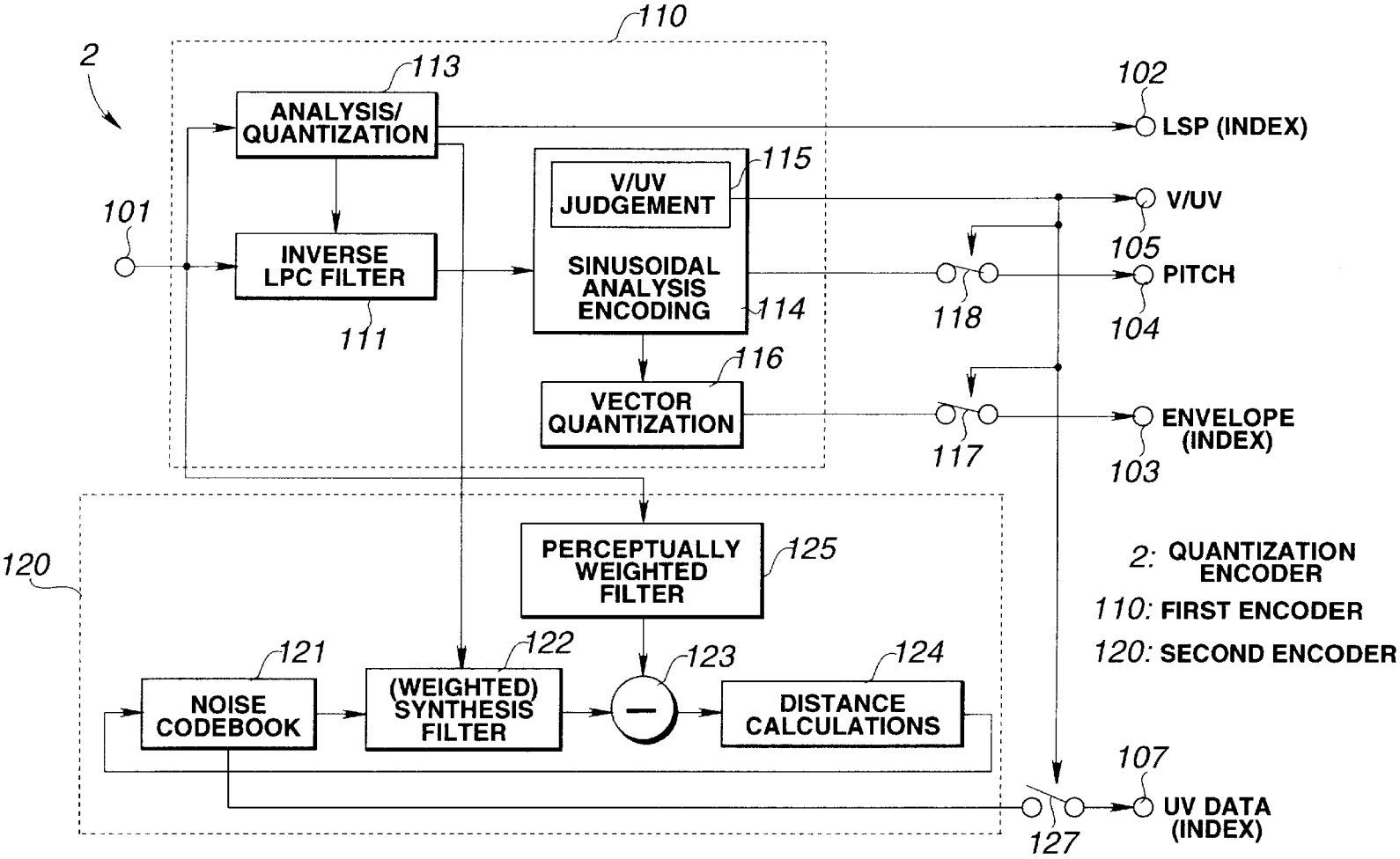
FIG. 2 is a schematic block diagram showing an encoding unit of the speech signal reproducing apparatus shown in FIG. 1.
Figure 3:
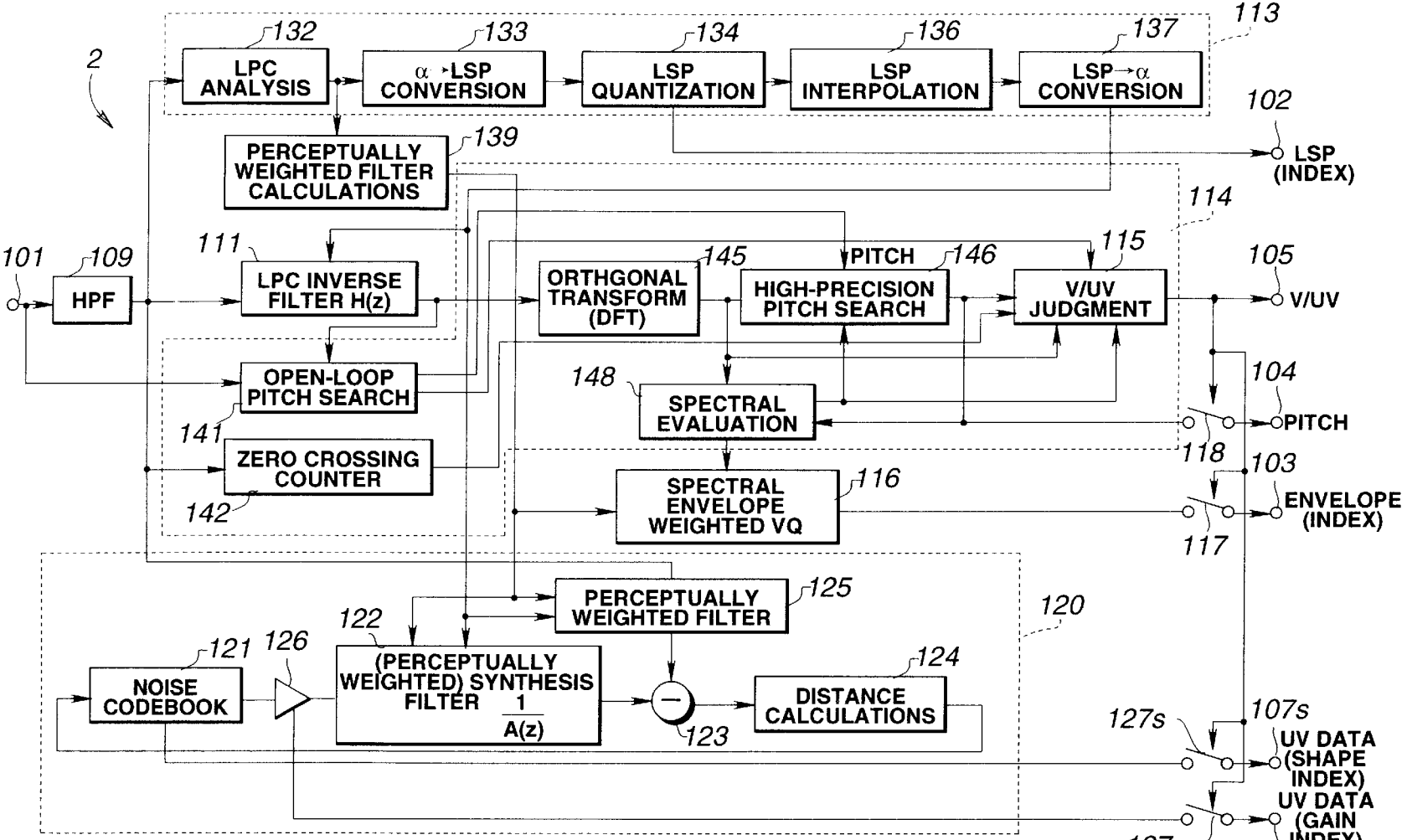
FIG. 3 is a block diagram showing a detailed structure of the encoding unit.

The encoding unit 2 is explained by referring to FIGS. 2 and 3. The encoding unit 2 decides, based on the results of discrimination, whether the input speech signal is voiced or unvoiced, and performs sinusoidal synthetic encoding for a signal portion found to be voiced. The encoding unit 2 performs a vector quantization of the unvoiced portion of the signal by a closed-loop search of the optimum vector using an analysis-by-synthesis method. Thus, the encoded parameters for the voiced and unvoiced portions of the signal are found. More specifically, the encoding unit 2 includes a first encoding unit 110 for finding short-term prediction residuals of the input speech signal, such as linear prediction coding (LPC) residuals. These residuals are used to perform sinusoidal analysis encoding, such as harmonic encoding of the voiced portion of the input signal. A second encoding unit 120 performs waveform coding by transmitting phase components of the unvoiced portion of the input speech signal. Thus, the first encoding unit 110 and the second encoding unit 120 are used for encoding the voiced (V) portion and the unvoiced (UV) portion, respectively.

In the embodiment of FIG. 2, the speech signal supplied to the input terminal 101 is sent to an inverse LPC filter 111 and to an LPC analysis quantization unit 113 of the first encoding unit 110. The LPC coefficient obtained from the LPC analysis/quantization unit 113 (the $\alpha$-parameter) is sent to the inverted LPC filter 111 for subtracting the linear prediction residuals (LPC residuals) from the input speech signal by the inverse LPC filter 111. From the LPC analysis/quantization unit 113, a quantized output of the linear spectral pairs (LSP) are extracted, as will later be explained, and sent to an output terminal 102. The LPC residuals from the inverted LPC filter 111 are sent to a sinusoidal analysis encoding unit 114. The sinusoidal analysis encoding unit 114 performs pitch detection and spectral envelope amplitude calculations. V/UV discrimination of the voiced (V)/unvoiced (UV) signal portions is performed by the V/UV judgement unit 115. The spectral envelope amplitude data from the sinusoidal analysis encoding unit 114 are sent to the vector quantization unit 116. The codebook index from the vector quantization unit 116, which is a vector-quantized output of the spectral envelope, is sent via a switch 117 to an output terminal 103. The output of the sinusoidal analysis encoding unit 114 is sent via a switch 118 to an output terminal 104. The V/UV discrimination output from the V/UV judgement unit 115 is sent to an output terminal 105 and to the switches 117, 118 as a switching control signal. For the voiced (V) signal, the switches 117, 118 are closed and the index and the pitch data are present at the output terminals 103, 104.

Operations of the vector quantization unit 116 will now be explained. First, a suitable number of dummy data sets are appended to the beginning and to the end of the data set output by the sinusoid encoding unit 114 so that the number of data blocks equals $N_F$. Then, an Os-tuple number of amplitude data points are found by band-limiting type Os-tuple over sampling, such as octatuple over sampling. The Os-tuple number of the amplitude data points, ((mMx+

1)×Os number of data) is further expanded to a larger number of $N_M$, such as 21048, by linear interpolation. This $N_M$ number data is converted into the pre-set number M (such as 44) by decimation. Vector quantization is then performed on the this set of data points.

In the present embodiment, the second encoding unit 120 has a code excited linear predictive (CELP) coding configuration and performs vector quantization on the time-domain waveform by a closed-loop search employing an analysis-by-synthesis method. Specifically, the output of a noise codebook 121 is synthesized by a weighted synthesis filter 122 to produce a weighted synthesized signal that is sent to a subtractor 123. An error value between the weighted synthesized speech and the speech supplied to the input terminal 101 is calculated and is subsequently processed by a perceptually weighted filter 125. A distance calculation circuit 124 calculates the error or distance from the true value, and a vector which minimizes the error is searched for in the noise codebook 121. This CELP encoding is used for encoding the unvoiced portion as described above. The codebook index of the UV data from the noise codebook 121 is output at terminal 107 via a switch 127 that is turned on when the results of V/UV discrimination from the V/UV discrimination unit 115 indicate an unvoiced (UV) sound.

Referring to FIG. 3, a more detailed structure of a speech signal encoder shown in FIG. 1 is explained. In FIG. 3, the parts or components similar to those shown in FIG. 1 are denoted by the same reference numerals.

In the speech signal encoder 2 shown in FIG. 3, the speech signals supplied to the input terminal 101 are filtered by a high-pass filter 109 to remove signals outside an expected audio range. The signals are then supplied to an LPC analysis circuit 132 of the LPC analysis/quantization unit 113 and to the inverse LPC filter 111.

The LPC analysis circuit 132 of the LPC analysis/quantization unit 113 applies a Hamming window, with the length of the input signal waveform on the order of 256 samples as a block, and finds linear prediction coefficients, that is the α-parameters, by the self-correlation method. The framing interval is set to approximately 160 samples. If, for example, the sampling frequency fs is 8 kHz then a one-frame interval is 20 msec and contains 160 samples.

The α-parameters from the LPC analysis circuit 132 are sent to an α-LSP conversion circuit 133 for conversion into line spectra pair (LSP) parameters. This converts the α-parameters, which are the coefficients for a ten-order filter. The α-coefficients may, for example, be pairs of the LSP parameters. This conversion may be carried out by the Newton-Rhapson method. The reason the α-parameters are converted into the LSP parameters is that the LSP parameters are superior in interpolation characteristics to the α-parameters.

The LSP parameters from the α-LSP conversion circuit 133 are matrix- or vector-quantized by the LSP quantizer 134. One possible method of quantization is to take frame-to-frame differences prior to vector quantization, or to collect a number of frames together to perform matrix quantization. In the present case, the LSP parameters, calculated every 20 msec, are vector-quantized, with a 20 msec frame size.

The quantized output of the quantizer 134, which is the index data of the LSP quantization, is output from the decoding unit 103 at terminal 102. The quantized LSP vector is sent to an LSP interpolation circuit 136.

The LSP interpolation circuit 136 interpolates the LSP vectors that are quantized every 20 msec or 40 msec at an octatuple rate. That is, the LSP vector is updated every 2.5 msec. The reason the LSP vectors are interpolated at a higher rate than the quantization rate is that, because the residual waveform is processed with analysis/synthesis by the harmonic encoding/decoding method, the envelope of the synthetic waveform is extremely smooth. If the LPC coefficients are changed abruptly every 20 msec, a foreign noise is likely to be produced. If the LPC coefficient is changed gradually every 2.5 msec, such foreign noise will be suppressed.

For inverted filtering of the input signal using the interpolated LSP vectors, produced every 2.5 msec, the LSP parameters are converted by the LSP-to-α conversion circuit 137 into α-parameters as coefficients of, for example, a ten-order direct-type filter. An output of the LSP-to-α conversion circuit 137 is sent to the LPC inverted filter circuit 111 that then performs inverted filtering to produce a smooth output using α-parameters updated every 2.5 msec. The output of the inverted LPC filter 111 is sent to an orthogonal transform circuit 145 to perform, for example, a discrete cosine transform (DCT).

The α-parameters from the LPC analysis circuit 132 of the LPC analysis/quantization unit 113 are sent to a perceptually weighted filter calculating circuit 139 where data for perceptual weighting is found. These weighted data are sent to the perceptually weighted vector quantizer 116, perceptually weighted filter 125 of the second encoding unit 120 and to the perceptually weighted synthesis filter 122.

The sinusoidal analysis encoding unit 114 of the harmonic encoding circuit analyzes the output of the inverted LPC filter 111 by harmonic encoding. That is, pitch detection, calculations of the amplitudes Am of the respective harmonics and voiced (V)/unvoiced (UV) discrimination, are carried out, and the amplitudes Am or the envelopes of the respective harmonics, varied with the pitch, are made constant by dimensional conversion.

In an illustrative example of the sinusoidal analysis encoding unit 114 shown in FIG. 3, ordinary harmonic encoding is used. In particular, in multi-band excitation (MBE) encoding, it is assumed that voiced portions and unvoiced portions are each present in the frequency area or band at the same time, that is, in the same block or frame. In other harmonic encoding techniques, a decision is first made whether the signal in one block or in one frame is voiced or unvoiced. In the following description, a given frame is judged to be UV if the totality of the band is UV.

The open-loop pitch search unit 141 and the zero-crossing counter 142 of the sinusoidal analysis encoding unit 114 of FIG. 3 are fed with the input speech signal from the input terminal 101 and with the signal from the high-pass filter (HPF) 109, respectively. The orthogonal transform circuit 145 of the sinusoidal analysis encoding unit 114 is supplied with LPC residuals from the inverted LPC filter 111. The open loop pitch search unit 141 takes the LPC residuals of the input signals to perform a relatively rough pitch search using an open loop. The extracted rough pitch data is sent to a high-precision pitch search unit 146 that performs a closed loop search, as will be explained later. From the open loop pitch search unit 141, the maximum value of the normalized autocorrelation parameter r(p), obtained by normalizing the maximum value of the self-correlation of the LPC residuals along with the rough pitch data, are sent to the V/UV discrimination unit 115.

The orthogonal transform circuit 145 performs an orthogonal transform, such as a discrete Fourier transform (DFT), to convert the LPC residuals on the time axis into spectral amplitude data on the frequency axis. The output of the orthogonal transform circuit 145 is sent to the high-precision pitch search unit 146 and a spectral evaluation unit 148 for evaluating the spectral amplitude or envelope.

The high-precision pitch search unit 146 is fed with rough pitch data extracted by the open loop pitch search unit 141 and with frequency-domain data obtained by DFT by the orthogonal transform unit 145. The high-precision pitch search unit 146 swings the pitch data by plus-or-minus several samples, at a rate of 0.2 to 0.5, centered about the rough pitch value, in order to arrive ultimately at the value of the high-precision pitch data having a predetermined level of precision. The analysis-by-synthesis method is used as the high-precision search technique for selecting the pitch, so that the power spectrum of the encoded signal will be closest to the power spectrum of the original sound. Pitch data from the closed-loop high-precision pitch search unit 146 is sent to output terminal 104 via switch 118.

In the spectral evaluation unit 148, the amplitude of each harmonic and the spectral envelope of the sum of the harmonics are evaluated based on the spectral amplitude and the pitch as found by the orthogonal transform unit 145 and sent to the high-precision pitch search unit 146, V/UV discrimination unit 115 and to the perceptually weighted vector quantization unit 116.

The V/UV discrimination unit 115 discriminates V/UV of a frame based on the output of the orthogonal transform circuit 145, on an optimum pitch from the high-precision pitch search unit 146, on the spectral amplitude data from the spectral evaluation unit 148, on the maximum value of the normalized self-correlation parameter r(p) from the open loop pitch search unit 141, and on the zero-crossing count value from the zero-crossing counter 142. In addition, the boundary position of the band-based V/UV discrimination for MBE may also be used as a condition for V/UV discrimination. A discrimination output of the V/UV discrimination unit 115 is sent to output terminal 105.

The output unit of the spectrum evaluation unit 148 or the input unit of the the vector quantization unit is provided with a data number conversion unit for setting the amplitude data |Am| of an envelope taking into account the fact that the number of discrete bands on the frequency axis and the number of data points differ with the pitch. That is, if the effective signal frequency is up to 3400 kHz, this range can be split into 8 to 63 bands depending on the pitch. The number of mMX+1 of the amplitude data points |Am|, obtained from band to band is varied over a rang e from 8 to 63. Thus, the data number conversion unit converts the amplitude data of the variable number mMx+1 of data points to a pre-set number M of data points, for example, 44 data points.

The amplitude data or envelope data of the M data points, from the data number conversion unit is vector-quantized by the spectral envelope weighed vector quantization unit 116. Weighting is supplied by the output of the perceptually weighted filter calculation circuit 139. The index of the envelope from the vector quantizer 116 is sent via switch 117 at output terminal 103. Prior to weighted vector quantization, it is advisable to take an inter-frame difference using a suitable leakage coefficient for a vector made up of a pre-set number of data points.

Operation of the second encoding unit 120 will now be explained. The second encoding unit 120 employs a code excited linear prediction (CELP) coding structure and is used for encoding the unvoiced portion of the input speech signal. In the CELP encoding method for the unvoiced speech portion of the signal, a noise output corresponding to the LPC residuals of the unvoiced portion of the signals is sent via gain circuit 126 to the perceptually weighted synthesis filter 122. The LPC residuals are represented by the output of the noise codebook 121 which is a stochastic codebook. The speech signal supplied from the input terminal 101 via high-pass filter (HPF) 109 and the perceptually weighting filter 125 is fed to the subtractor 123. The subtractor 123 finds a difference or error signal between the perceptually weighted speech signal and the signal from the synthesis filter 122. This error signal is fed to a distance calculation circuit 124 to find the distance and a representative value vector which will minimize the error is sought by the noise codebook 121. The above is a summary of the vector quantization of the time-domain waveform employing the closed-loop search that, in turn, employs the analysis by synthesis method.

Data corresponding to the unvoiced (UV) portion of the speech signal from the second encoder 120 employing the CELP coding structure are the shape index from the noise codebook 121 arid the gain index from the gain circuit 126. The shape index, that is the UV data from the noise codebook 121, is sent via switch 127*s* to output terminal 107*s*. The gain index, that is the UV data of the gain circuit 126, is sent via switch 127*g* to output terminal 107*g*.

These switches 127*s* and 127*g* and the switches 117 and 118 are turned on and off depending on the results of the V/UV decision from the V/UV discrimination unit 115. Specifically, the switches 117, 118 are turned on if the results of the V/UV discrimination of the speech signal of the frame about to be transmitted indicates a voiced (V) signal. The switches 127*s*, 127*g* are turned off if the speech signal of the frame about to be transmitted is an unvoiced (UV) signal.

The encoded parameters output from the encoding unit 2 are supplied to the period changing unit 3. The period changing unit 3 modifies the output period of the encoded parameters by time-axis compression/expansion. The encoded parameters, outputted at a modified period by the period changing unit 3, are sent to the decoding unit 4.

The decoding unit 4 includes the parameter changing unit 5 for interpolating the encoded parameters that have been compressed along the time axis by the period changing unit 3. The parameter modification unit 5 generates modified encoded parameters associated with time points at predetermined time intervals. The decoding unit 4 also includes the speech synthesis unit 6 for synthesizing the voiced speech signal portion and the unvoiced speech signal portion based on modified encoded parameters.

Figure 4:
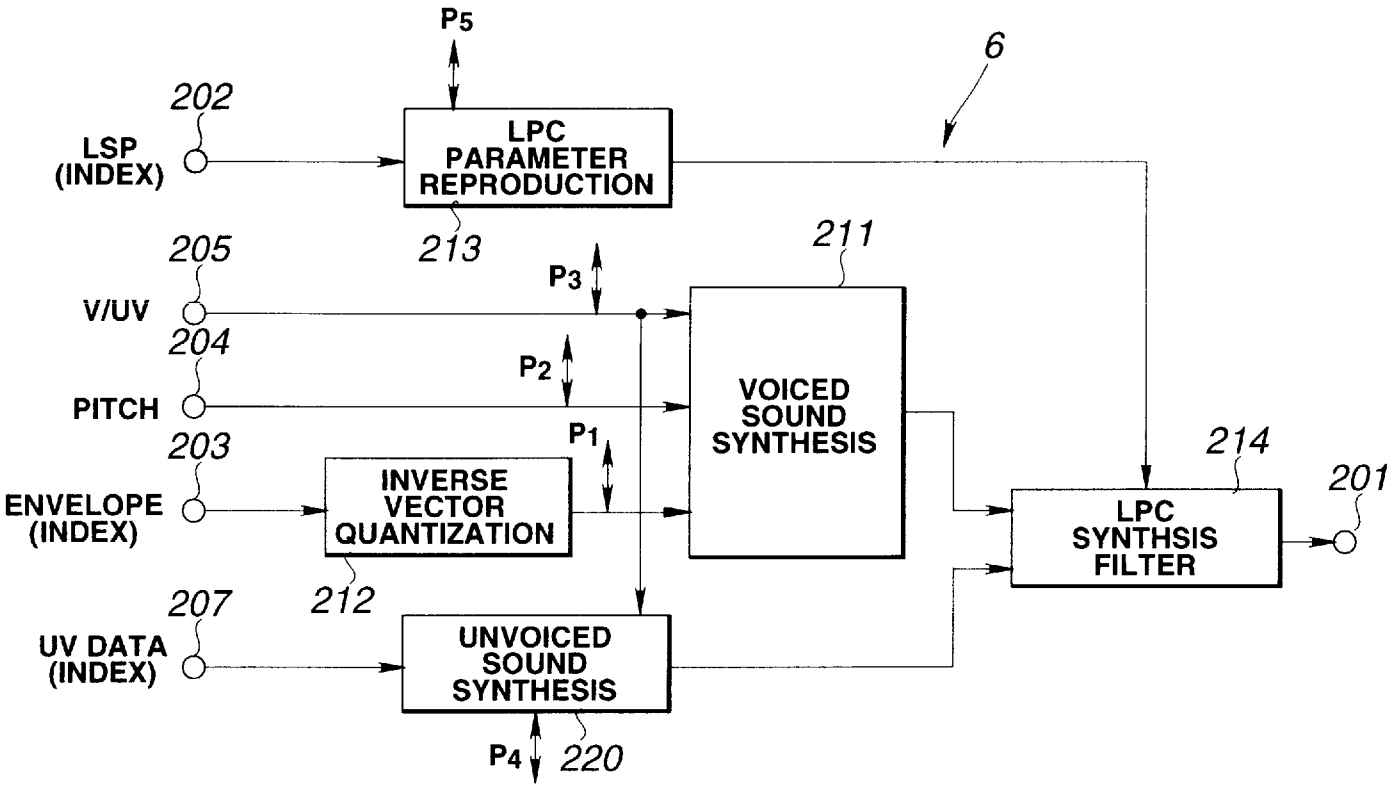
FIG. 4 is a schematic block diagram showing the structure of a decoding unit of the speech signal reproducing apparatus shown in FIG. 1.
Figure 5:
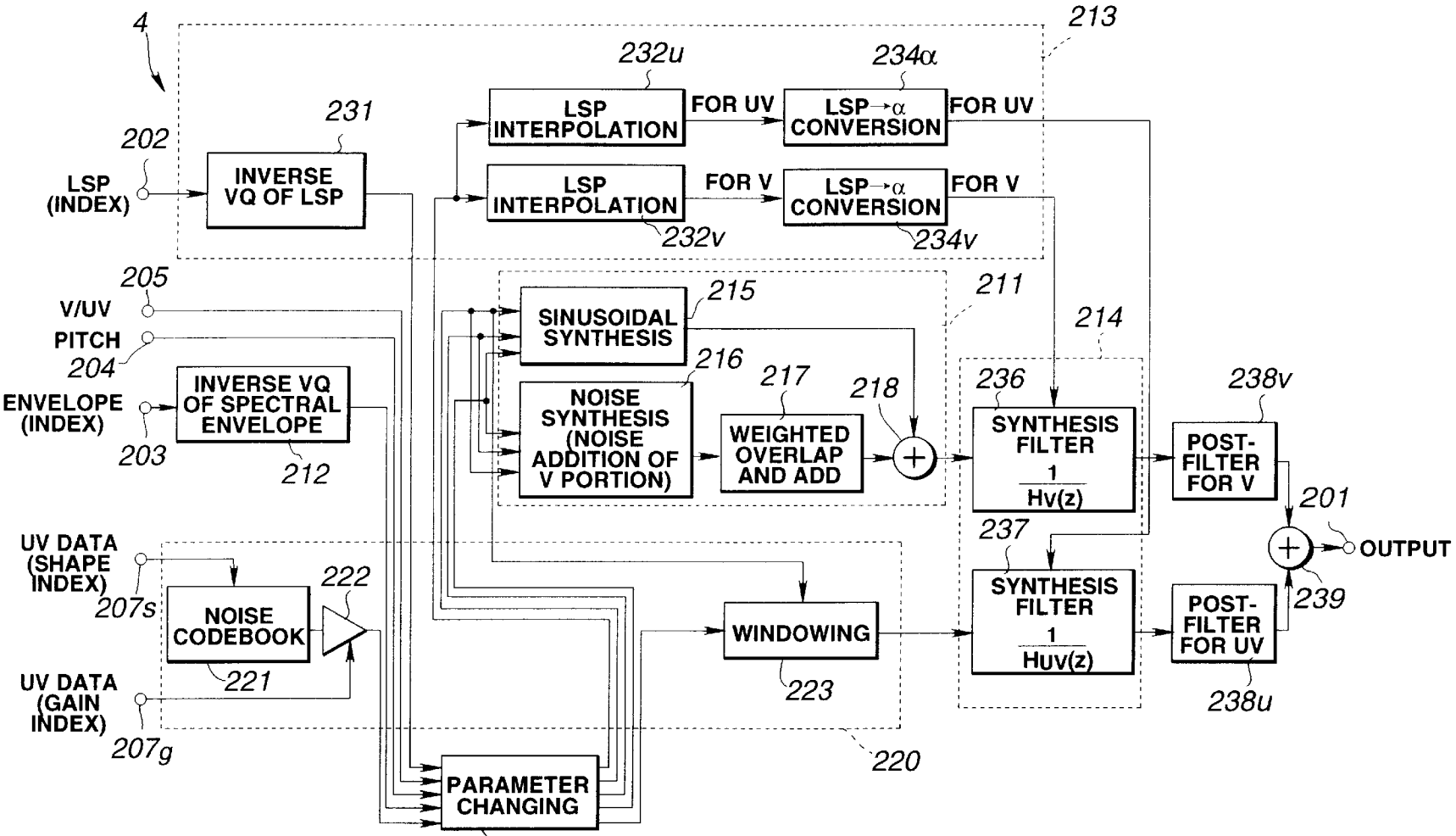
FIG. 5 is a block diagram showing a detailed structure of the decoding unit.

Referring to FIGS. 4 and 5, the decoding unit 4 will now be explained. In FIG. 4, the codebook index data, as quantized output data of the linear spectrum pairs (LSPs) from the period changing unit 3, are supplied to an input terminal 202. The other outputs of the period changing unit 3, that is, quantized envelope data, pitch data, and V/UV discrimination output data, are supplied to input terminals 203, 204, and 205, respectively. Index data for the unvoiced speech portion is supplied to input terminal 207.

The envelope index data from the input terminal 203 is sent to an inverse vector quantizer 212 for vector quantization to find the spectral envelope of the LPC residuals or errors. Before being sent to the voiced sound synthesis unit 211, the spectral envelope of the LPC residuals is transiently sampled at a point indicated by arrow $P_1$ in FIG. 4 by the parameter changing unit 5 for parameter modification. The envelope index data is then sent to the voiced speech synthesis unit 211.

The voiced speech synthesis unit 211 synthesizes the LPC residuals of the voiced speech signal portion by sinusoidal synthesis. The pitch and the V/UV discrimination data are transiently sampled at points $P_2$ and $P_3$, respectively, in FIG. 4 by the parameter changing unit 5 for parameter modification. Pitch and V/UV discrimination data are similarly supplied to the synthesis speech synthesis unit 211. The LPC residuals of the voiced portion of the signal from the voiced speech synthesis unit 211 are sent to the LPC synthesis filter 214.

The UV index data from the input terminal 207 is sent to an unvoiced speech synthesis unit 220. The index data of the UV data is converted to LPC residuals of the unvoiced portion of the speech signal by the unvoiced speech synthesis unit 220 by making reference to the noise codebook 221. The index data of the UV data are transiently sampled at from the unvoiced speech synthesis unit 220 by the parameter changing unit 5 as indicated at $P_4$ in FIG. 4 for parameter modification. The LPC residuals, thus processed with parameter modification, are sent to the LPC synthesis filter 214.

The LPC synthesis filter 214 performs independent LPC synthesis on the LPC residuals of the voiced speech signal portion and on the LPC residuals of the unvoiced speech signal portion. Alternatively, the LPC synthesis may be performed on the sum of the LPC residuals of the voiced speech signal portion and the LPC residuals of the unvoiced speech signal portion.

The LSP index data from the input terminal 202 are sent to an LPC parameter regenerating unit 213. Although the α-parameters of the LPC are ultimately produced by the LPC parameter regenerating unit 213, the inverse vector quantized data of the LSP are taken out partway by the parameter changing unit 5 as indicated by arrow $P_5$ for parameter modification.

The dequantized data, thus processed with parameter modification, is returned to the LPC parameter regenerating unit 213 for LPC interpolation. The dequantized data is then turned into α-parameters that are supplied to the LPC synthesis filter 214. The speech signals, obtained by LPC synthesis by the LPC synthesis filter 214, are sent to output terminal 201. The speech synthesis unit 6, shown in FIG. 4, receives modified encoded parameters, calculated by the parameter changing unit 5 as described above, and outputs synthesized speech. A more specific configuration of the speech synthesis unit is shown in FIG. 5, in which parts or components corresponding to those shown in FIG. 4 are identified by the same numerals.

Referring to FIG. 5, the LSP index data enters at input terminal 202 and is sent to an inverse vector quantizer 231 for LSPs in the LPC parameter regenerating unit 213. The LSP index data is inverse vector quantized into LSPs (line spectrum pairs) that are supplied to the parameter changing unit 5.

The vector-quantized index data of the spectral envelope Am from the input terminal 203 is sent to the inverse vector quantizer 212 for inverse vector quantization and is converted into data defining the spectral envelope. This spectral envelope data is sent to the parameter changing unit 5.

The pitch data and the V/UV discrimination data from input terminals 204 and 205 are also sent to the parameter changing unit 5.

Input terminals 207*s* and 207*g* of FIG. 5 receive shape index data and gain index data respectively as UV data from output terminals 107*s* and 107*g* of FIG. 3 via the period changing unit 3. The shape index data and the gain index data are supplied to the unvoiced speech synthesis unit 220. The shape index data from the terminal 207*s* and the gain index data from the terminal 207*g* are supplied to a noise codebook 221 and to a gain circuit 222 of the unvoiced speech synthesis unit 220, respectively. A representative value from the noise codebook 221 is the noise signal component corresponding to the LPC residuals of the unvoiced portion of the speech signal becomes the amplitude of the gain in the gain circuit 222. The resulting signal is supplied to the parameter changing unit 5.

The parameter changing unit 5 interpolates the encoded parameters that were output from the encoding unit 2 and modified by the period changing unit 3. The parameter changing unit 5 generates modified encoded parameters that are supplied to the speech synthesis unit 6. The parameter changing unit 3 modifies the time-axis positions of the encoded parameters prior to decoding. Thus, the speech signal reproducing apparatus 1 can utilize algorithms at a fixed data rate when speech signal speeds are modified. referring to the flowcharts of FIGS. 6 and 8, the operation of the period changing unit 3 and the parameter changing unit 5 are explained.

Figure 6:
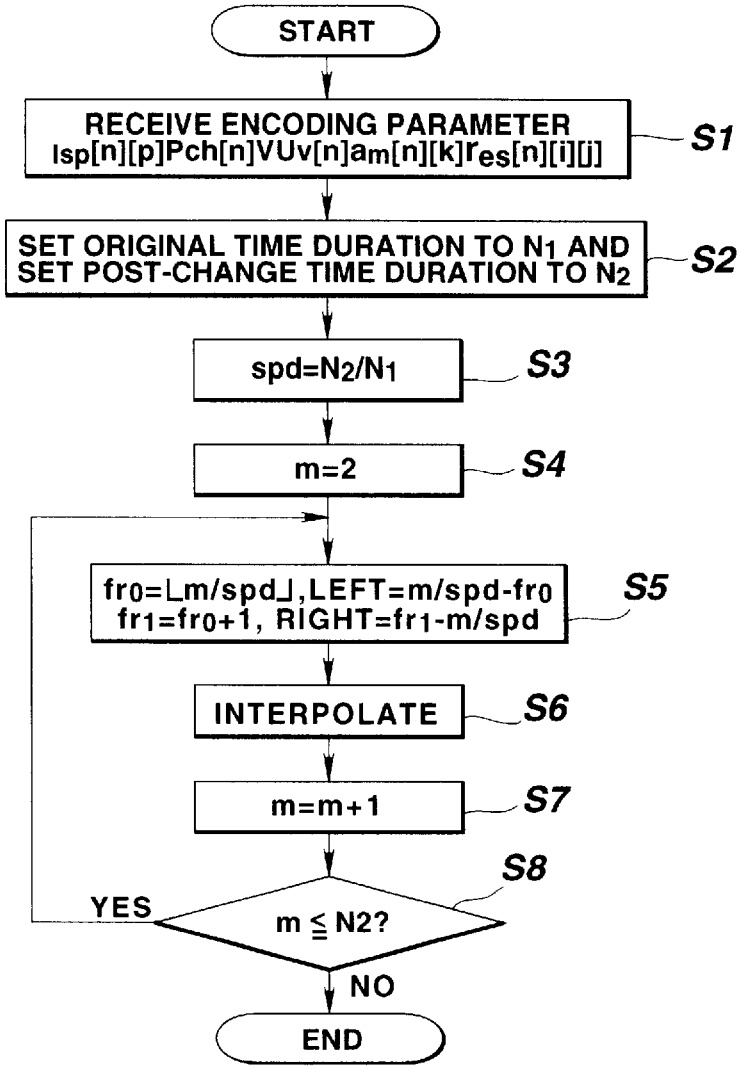
FIG. 6 is a flowchart for illustrating the operation of a unit for calculating modified encoding parameters of the decoding unit.

At step S1 of FIG. 6, the period changing unit 3 receives encoded parameters, such as LSPs, pitch, voiced/unvoiced (V/UV), spectral envelope Am, or LPC residuals. The LSPs, pitch, V/UV, Am, and the LPC residuals are represented as $l_{sp}[n][p]$, $P_{ch}[n]$, $vu_v[n]$, $a_m[n][k]$ and $r_{es}[n][i][j]$, respectively.

The modified encoded parameters, ultimately calculated by the parameter changing unit 5, are represented as mod-$l_{sp}[m][p]$, mod -$p_{ch}[m]$, mod-$vu_v[m]$, mod-$a_m[m][k]$ and mod-$r_{es}[m][i][j]$, where k and p denote the number of harmonics and the number of LSP orders, respectively. Parameters n and m denote frame numbers corresponding to time-domain index data prior and subsequent to time axis conversion, respectively. Where frames occur at an interval of 20 msec. Parameters i and j denote a sub-frame number and a sample number, respectively.

The period changing unit 3 then sets the number of frames representing the original time duration to $N_2$ and the number of frames representing the time duration after changing to $N_2$ as shown at step S2. The period changing unit 3 then performs a time-axis compression of the $N_1$ frames to $N_2$ as shown at step S3. That is, the time-axis compression ratio spd in the period changing unit 3 is found as $spd=N_2/N_1$, where $0 \leqq n < N_1$ and $0 \leqq m < N_2$.

The parameter changing unit 5 then sets m, the frame number corresponding to the index of the time axis after time axis modification, to 2.

The parameter changing unit 5 then finds two frames $f_{r0}$ and $f_{r1}$ and the differences left and right between the two frames $f_{r0}$ and $f_{r1}$ and the ratio m/spd.

If the parameters $l_{sp}$, $p_{ch}$, $vu_v$, $a_m$ and $r_{es}$ are denoted as *, mod-*[m] may be represented by the general formula $$mod\text{-}*[m]=*[m/spd]$$

where $0 \leqq m < N_2$. Since m/spd is not an integer, however, the modified encoded parameter at m/spd is produced by interpolation from two frames of $f_{r0}=\lfloor m/spd \rfloor$ and $f_{r1}=f_0+1$.

Figure 7:
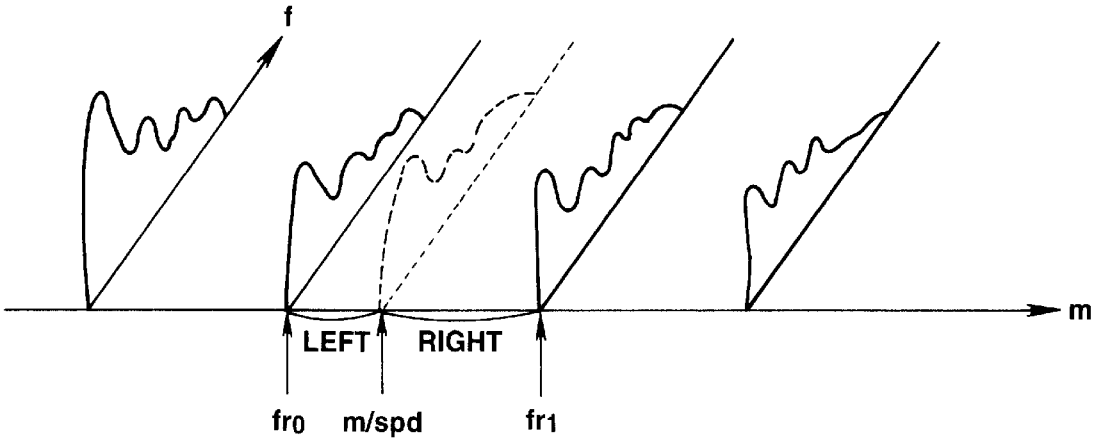
FIG. 7 schematically illustrates the modified encoding parameters obtained by the modified encoding parameter calculating unit on the time axis.

The frame $f_{r0}$ m/spd and the frame $f_{r1}$ are related as shown in FIG. 7, namely $left=m/spd-f_{r0}$ $right=f_{r1}-m/spd$ The encoded parameters for m/spd in FIG. 7, namely the modified encoded parameters, may be found by interpolation as shown at step S6.

The modified encoded parameter is simply found by linear interpolation by:

$$\text{mod-*}[m]=*[f_{r0}]\times\text{right}+*[f_{r1}]\times\text{left}$$

With interpolation between the two frames $f_{r0}$ and $f_{r1}$, however, the above general formula cannot be used if one of the two frames is V and the other is UV. Therefore, the parameter changing unit 5 changes the method for finding the encoded parameters depending on the voiced (V) or unvoiced (UV) character of the two frames $f_{r0}$ and $f_{r1}$ as indicated by steps S11 through S21 of FIG. 8.

First, the voiced (V) or unvoiced (UV) character of the two frames $f_{r0}$ and $f_{r1}$ is determined, as shown at step S11. If the two frames $f_{r0}$ and $f_{r1}$ are both found to be voiced (V), processing transfers to step s12 where all parameters are linearly interpolated and represented by:

$$mod\text{-}p_{ch}[m]=p_{ch}[f_{r0}]\times\text{right}+p_{ch}[f_{r1}]\times\text{left}$$

$$mod\text{-}a_m[m][k]=a_m[f_{r0}][k]\times\text{right}+a_m[f_{r1}][k]\times\text{left}$$

where $0\leqq k<L$, where L is the maximum possible number of harmonics. For $a_m[n][k]$, 0 (zero) is inserted where there are no harmonics. If the number of harmonics differs between the frames $f_{r0}$ and $f_{r1}$ 0s (zeros) are inserted in vacant positions. Alternatively, a fixed number such as $0\leqq k<L$, where L=43, may be used to fill vacant positions.

$$mod\text{-}l_{sp}[m][p]=l_{sp}[f_{r0}][p]\times\text{right}+l_{sp}[f_{r1}][p]\times\text{left}$$

where $0\leqq p<P$, where P denotes the number of orders of the LSPs and is usually 10.

$$mod\text{-}vu_v[m]=1$$

In V/UV discrimination, 1 and 0 denote voiced (V) and unvoiced (UV) , respectively.

If, at step S11, either of the two frames $f_{r0}$ and $f_{r1}$ is judged to be unvoiced (UV), then a decision is made at step S13 as to whether both the two frames $f_{r0}$ and $f_{r1}$ are unvoiced (UV). If the result at step S13 is Yes, the interpolation unit 5 slices 80 samples ahead and at the back of $r_{es}$, with m/spd as center and with $p_{ch}$ as a maximum value, as indicated at step S14.

In effect, if left<right at step S14, 80 samples ahead and at back of $r_{es}$, centered about m/spd, are sliced, and inserted into mod-$r_{es}$, as shown in FIG. 9A. On the other hand, if left≧right at this step S14, the interpolation unit 5 slices 80 samples ahead and at the back of $r_{es}$, centered about m/spd, to produce mod-$r_{es}$, as shown in FIG. 9B. That is, $$\text{for } (j=0;\ j<FRM\times(½-m/spd+f_{r0});\ j^{++}\{mod\text{-}r_{es}[m][0][j]=r_{es}[f_{r0}][0][j+(m/spd-f_{r0})\times FRM];\};$$

$$\text{for } (j=FRM\times(½-m/spd+f_{r0});\ j<FRM/2;\ j^{++})\{mod\text{-}r_{es}[m][0][j]=r^{es}[m][0][j]=r_{es}[f_{r0}][1][j-FRM\times(½-m/spd+f_{r0})];\};$$

$$\text{for } (j=0;\ j<FRM\times(½-m/spd+f_{r0};\ j^{++})\{mod\text{-}r_{es}[m][1][j]=r_{es}[f_{r0}][1][j+(m/spd-f_{r0})\times FRM];\};$$

$$\text{for } (j=FRM\times(½-m/spd+f_{r0})j=FRM/2;\ j^{++})\{mod\text{-}r_{es}[m][1][j]=r_{es}[f_{r0}][0][j+FRM\times(½-m/spd+f_{r0})];\};$$

where FRM is e.g., 160.

If the condition of step S13 is not met, processing transfers to step S15 where it is determined whether the frame $f_{r0}$ is voiced (V) and the frame $f_{r1}$ is unvoiced (UV). If the result of judgment is YES, processing transfers to step S16. If the result of the decision is NO, that is, if the frame $f_{r0}$ is unvoiced (UV) and the frame $f_{r1}$ is voiced (V), processing transfers to step S17.

In the processing of the steps S15 and following, the two frames $f_{r0}$ and $f_{r1}$ are different as to V/UV. One is voiced (V) and the other is unvoiced (UV) . This takes into account the fact that if parameters are interpolated between two frames $f_{r0}$ and $f_{r1}$, which are different as to V/UV, the results of interpolation are meaningless.

At step S16, the length of left time interval (=m/spd $f_{r0}$) and that of the right time interval(=$f_{r1}$−m/spd) are compared to each other, in order to decide if the frame $f_{r0}$ is closer to m/spd.

If the frame $f_{r0}$ is closer to m/spd, the modified encoded parameters are set, using the parameters of the frame $f_{r0}$ so that mod-$p_{ch}$[m]=$p_{ch}$[$f_{r0}$]

mod-$a_m$[m][k]=$a_m$[$f_{r0}$][k], where $0\leqq k<L$;

mod-l[m][p]=$l_{sp}$[$f_{r0}$][p], where $0\leqq p<I$; and mod-$v_u$[m]=1 as shown at step S18.

If the result of judgment at step S16 is NO, left≧right, and the frame $f_{r1}$ is closer processing transfers to step S19 to maximize the pitch. Also, $r_{es}$ of the frame $f_{r1}$ is used directly as shown in FIG. 9C. That is, mod-$r_{es}$[m][i][j]=$r_{es}f_{r1}$[i][j ]. The reason is that, for voiced frame $f_{r0}$, the LPC residuals $r_{es}$ are not transmitted.

At step S17, a decision similar to that at step S16 is made on the basis of the decision given at step S15 that the two frames $f_{r0}$ and $f_{r1}$ are unvoiced (UV) and voiced (V), respectively. That is, the lengths of the left time interval (=m/spd−$f_{r0}$) and the right time interval (=$f_{r1}$−m/spd) are compared to each other in order to decide whether the frame $f_{r0}$ is closer to m/spd than the frame $f_{r1}$.

If the frame $f_{r0}$ is closer, processing transfers to step S18 to maximize the pitch. Also, $r_{es}$ of the frame $f_{r0}$ is used directly. That is, mod-$r_{es}$[m][i][j]=$r_{es}f_{r0}$[i][j]. The reason is that, for a voiced frame $f_{r1}$, the LPC residuals $r_{es}$ are not transmitted.

If the result of the decision at step S17 is NO, left ≧right and hence the frame $f_{r0}$ is closer to m/spd processing proceeds to step S21 and the modified encoded parameters are set, using the parameters of the frame $f_{r1}$, so that mod-$p_{ch[m]=pch}$[$f_{r1}$]

mod-$a_m$[m][k]=$a_m$[$f_{r1}$][k], where $0\leqq k<L$;

mod-$l_{sp}$[m][p]=$l_{sp}$[$f_{r1}$][p], where $0\leqq p<I$; and mod-$vu_u$[m]=1.

Figure 8:
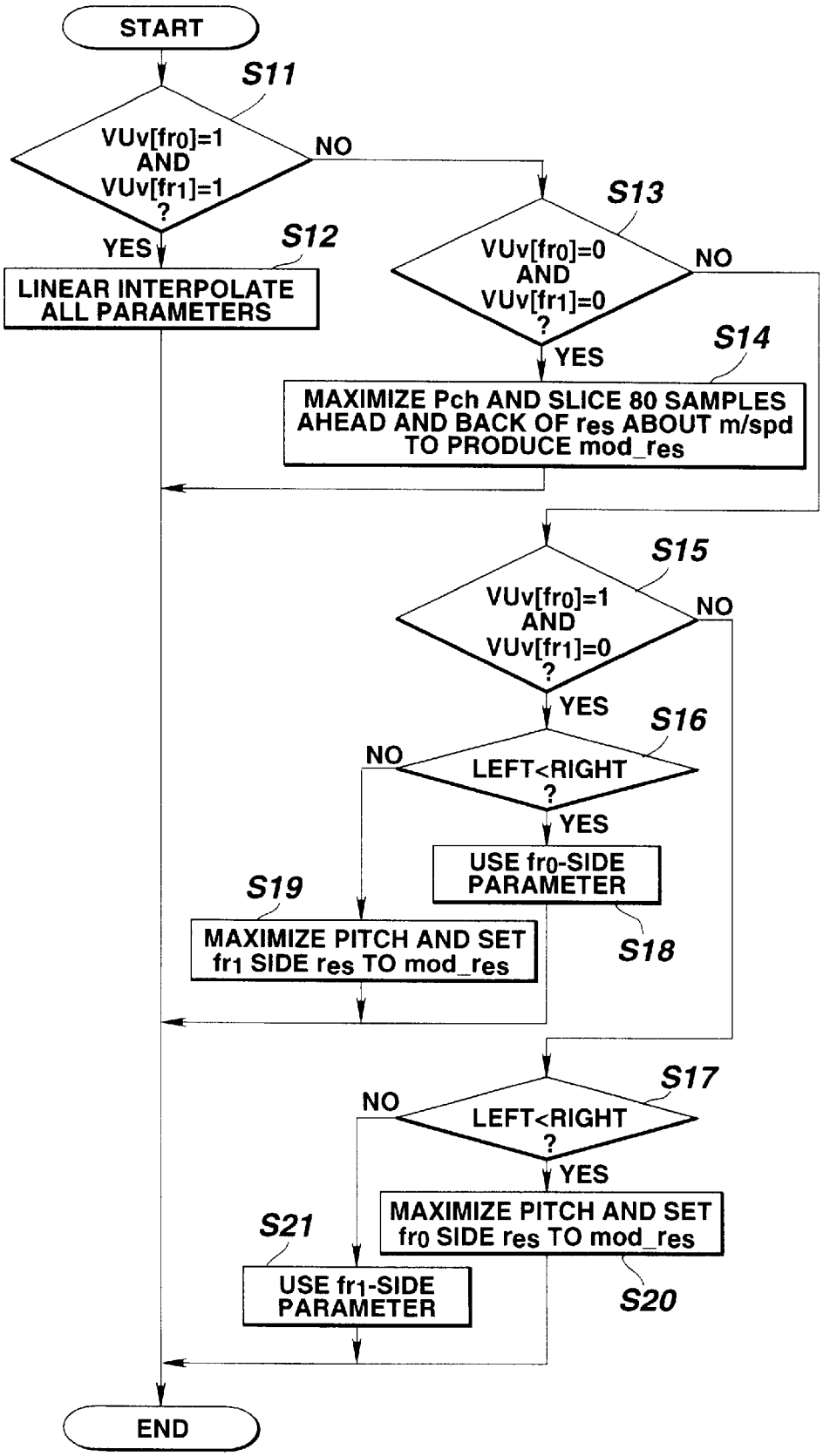
FIG. 8 is a flowchart for illustrating the detailed interpolation operation performed by the modified encoding parameter calculating unit.

In this manner, the interpolation unit 5 provides different operations for the interpolation in step S6 of FIG. 6 shown in detail in FIG. 8, depending on the V/UV character of the two frames $f_{r0}$ and $f_{r1}$. After interpolation at step S6, processing transfers to step S7 for incrementing the value of m. The operations in steps S5 and S6 are repeated until the value of m equals $N_2$.

Figure 10A:
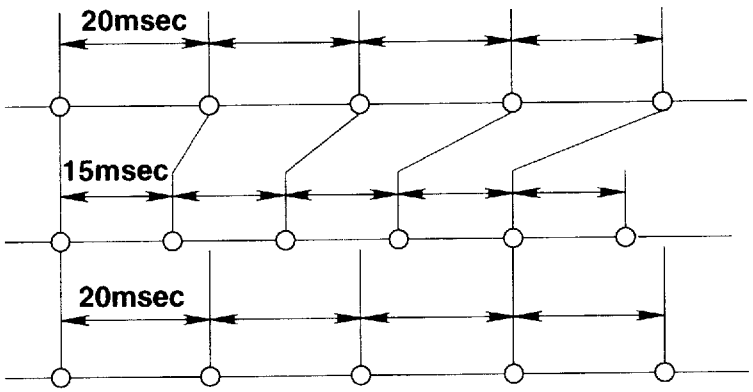

The operations of the period changing unit 3 and the parameter changing unit 5 are explained collectively by referring to FIGS. 10(A)–10(C). Referring to FIG. 10(A), the period of the encoding parameters, extracted every 20 msec of a period by the encoding unit 2, is modified by the period changing unit 5 by time-axis compression to 15 msec, as shown in FIG. 10(A). By the interpolation operation, responsive to the state of V/UV of the two frames $f_{r0}$ and $f_{r1}$, the parameter changing unit 5 calculates the modified encoded parameters every 20 msec, as shown in FIG. 10(C).

Figure 11A:
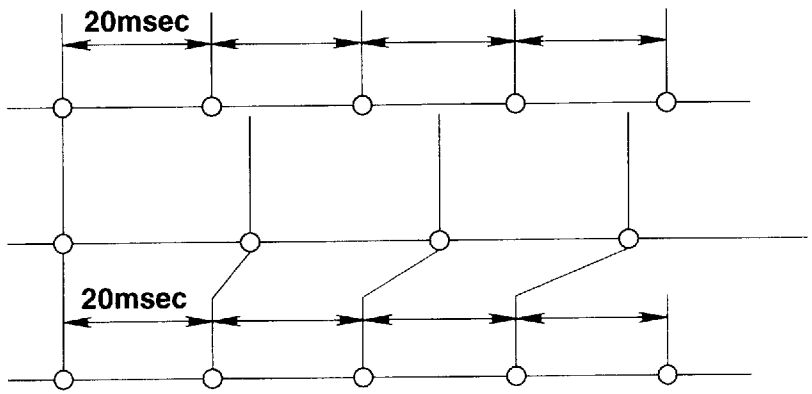

The sequence of operations of the period changing unit 3 and the parameter changing unit 5 may be reversed. The encoded parameters shown in FIG. 11(A) may be first interpolated as shown in FIG. 11(B) and subsequently compressed as shown in FIG. 11(C) in order to calculate the modified encoded parameters.

Returning to FIG. 5, the modified encoded parameters mod-$\mathbf{1}_{sp}$[m][p] of the LSP data, calculated by the parameter changing unit 5, are sent to LSP interpolation circuits $\mathbf{232}_v$, $\mathbf{232}_u$ for LSP interpolation. The resulting data is converted by LSP-to-α converting circuits $\mathbf{234}_v$, $\mathbf{234}_{uv}$ for conversion into an α-parameter for linear predictive coding (LPC). The α-parameter is sent to the LPC synthesis filter 214. The LSP interpolation circuit $\mathbf{232}_v$ and the LSP-to-α converting circuit $\mathbf{234}_v$ are used for the voiced (V) signal portion. The LSP interpolation circuit $\mathbf{232}_u$ and the LSP-to-α converting circuit $\mathbf{234}_u$ are used for the unvoiced (UV) signal portion. The LPC synthesis filter 214 is made up of an LPC synthesis filter 236 for the voiced portion of the speech signal and an LPC synthesis filter 237 for the unvoiced portion of the speech signal. The LPC coefficient interpolation is performed independently for the voiced portion and the unvoiced portion to prevent errors otherwise produced by interpolation of LSPs in the transient region between a voiced portion and an unvoiced portion of the signal.

The modified encoded parameter for the spectral envelope data mod-$a_m$[m][k], as found by the parameter changing unit 5, is sent to the sinusoidal synthesis circuit 215 of the voiced speech synthesis unit 211. The voiced speech synthesis unit 211 is also supplied with modified encoded parameter for the pitch mod-$p_{ch}$[m] and the modified encoded parameter mod-$vu_v$[m] for the V/UV decision data, as calculated by the parameter changing unit 5. From the sinusoidal synthesis circuit 215, the LPC residual data corresponding to the output of the LPC inverse filter 111 of FIG. 3 are sent to an adder 218.

The modified encoded parameter of the spectral envelope data mod-$a_m$[m][k], modified encoded parameter of the pitch $\text{mod}_{13}$ $p_{ch}$[m] and the modified encoded parameter of the V/UV decision data mod-$vu_u$[m], as found by the parameter changing unit 5, are sent to the noise synthesis circuit 216 for noise addition to the voiced (V) portion. The output of the noise synthesis circuit 216 is sent to the adder 218 via the weighted overlap-and-add circuit 217.

Specifically, the noise is synthesized by taking into account parameters derived from the encoded speech data, such as pitch spectral envelope amplitudes, maximum amplitude in the frame or residual signal level. This noise is added to the voiced portion of the LPC residual signal of the LPC synthesis filter input. The reason for this is that if the input to the LPC synthesis filter of the voiced speech produced by sinusoidal synthesis is not mixed with synthesised noise, voiced speech having a "stuffed" feeling is produced in low-pitch sounds, such as male speech. In addition, without noise the sound quality will change abruptly between the V and UV speech portions, thus producing voiced speech having an unrealistic feeling.

The output of the adder 218 is sent to the synthesis filter 236 for the voiced speech where the time waveform data is produced by LPC synthesis. The resulting time waveform data is filtered by a post-filter 238*v* and supplied to an adder 239.

Note that the LPC synthesis filter 214 is separated into the synthesis filter for voiced signals (V) 236 and the synthesis filter for unvoiced signals (UV) 237, as explained previously. If the synthesis filters are not separated in this manner, that is, if the LSPs are interpolated continuously every 20 samples or every 2.5 msec without making distinction between the V and UV signal portions, the LSPs of totally different character are interpolated at the U to UV to UV to V boundaries producing an artifact. To prevent this, the LPC synthesis filter is separated into a filter for V and a filter for UV for interpolating the LPC coefficients.

The modified encoded parameters of the LPC residuals mod-$r_{es}$ [m][i][j], as calculated by the parameter changing unit 5, are sent to the windowing circuit 223 for windowing to smooth the junction between the unvoiced portion and the voiced speech portion.

The output of the windowing circuit 223 is sent to the synthesis filter 237 for UV of the LPC synthesis filter 214 as the output of the unvoiced speech synthesis unit 220. The synthesis filter 237 performs LPC synthesis on the data to provide time waveform data for the unvoiced portion which is filtered by a post-filter for unvoiced speech 238*u* and then supplied to the adder 239.

The adder 239 adds the time waveform signal of the voiced portion from the post-filter $\mathbf{238}_v$ for voiced speech to the time waveform signal for the unvoiced speech portion from the post-filter for the unvoiced speech portion 238*u* and outputs the resulting data at output terminal 201.

With the present speech signal reproducing apparatus 1, an array of modified encoded parameters mod-*[m], where $0 \leqq m < N_2$ is decoded instead of the original array *[n], where $0 \leqq n < N_1$. The frame interval during decoding may be a fixed value. Conventionally an interval of 20 msec is selected. In such case, time axis compression and a speedup of the reproducing rate is realized for $N_2 < N_1$, while time axis expansion and resulting slow down of the reproducing rate is realized for $N_2 > N_1$.

Using the present system, the resulting parameter string has an inherent spacing of 20 msec for decoding, so that optional speedup may be realized easily. Moreover, speedup and slow down may be realized using the same algorithms at the same data rate in the reproducing apparatus.

Consequently, the contents of a solid-state recording can be reproduced at a speed, for example, twice the real-time speed. Since the pitch and the phoneme remain unchanged despite the increased playback speed, the recording contents can be understood despite reproduction at a significantly increased playback speed.

If $N_2 < N_1$, that is, if the playback speed is lowered, the playback sound tends to become unrealistic since many identical parameters mod-$r_{es}$ are produced from the same LPC residuals $r_{es}$ in the unvoiced frame. In this case, an appropriate amount of noise may be added to the parameters mod-$r_{es}$ to reduce this unrealistic feeling to some extent. Instead of adding noise, the parameters mod-$r_{es}$ may be replaced by suitably generated Gaussian noise, or an excitation vector, randomly selected from the codebook.

In the above-described speech signal reproducing apparatus 1, the time axis of the output period of the encoded parameters from the encoding unit 2 is compressed by the period changing unit 3 to increase the reproduction speed. The frame length, however, may also be rendered variable by the decoding unit 4 to control the reproduction speed.

In that case, since the frame length is rendered variable, the frame number n is not changed before and after parameter generation by the parameter changing unit 5 of the decoding unit 4.

Also, the parameter changing unit 5 modifies the parameters $l_{sp}$[n][p] and $vu_v$[n] to mod-$l_{sp}$[n][p] and to mod-$u_v$[n], respectively, regardless of whether the frame contains voiced or unvoiced data.

If mod-$vu_v$[n] is 1, that is, if the subject frame is voiced (V), the parameters $p_{ch}$[n] and $a_m$[n][k] are modified to mod-$p_{ch}$[n] and to mod-$a_m$[n][k], respectively.

If mod-$vu_v$[n] is 0, that is, if the subject frame is unvoiced (UV), the parameter $r_{es}$[n][i][j] is modified to mod-$r_{es}$[n][i][j].

The parameter changing unit 5 modifies $l_{sp}$[n][p], $p_{ch}$[n], $vu_v$[n] and $a_m$[n][k] directly to mod-$l_{sp}$[n][p], $p_{ch}$[n], mod-$vu_v$[n] and to mod-$a_m$[n][k]. The parameter changing unit, however, varies the residual signal mod-$r_{es}$[n][i][j] depending on the speed spd.

Figure 12:
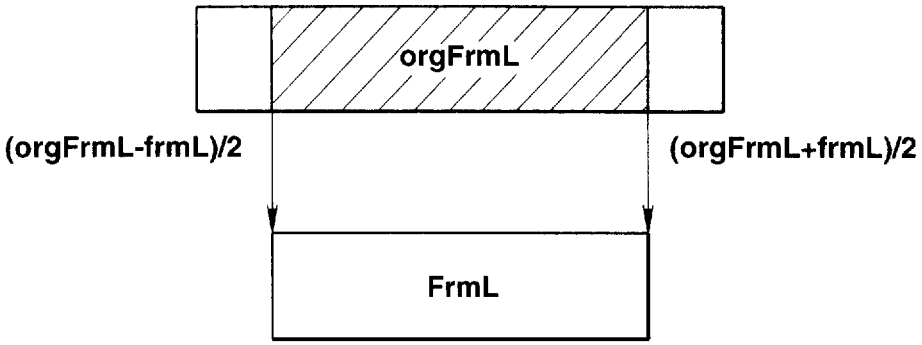
FIG. 12 illustrates an operation where the frame length is varied to increase the operating speed of the decoding unit.

If the speed spd<1.0, that is, if the reproduction speed is faster than the original speed, the residual signals of the original signal are taken from the mid-portion of the original signal, as shown in FIG. 12. If the original frame length is orgFrmL then (orgFrmL−frmL)/2≦j≦(orgFrmL+frmL)/2 is sliced from the original frame $r_{es}$[n][i] to give mod-$r_{es}$[n][i]. It is also possible that residual data may be taken from the leading end of the original frame.

Figure 13:
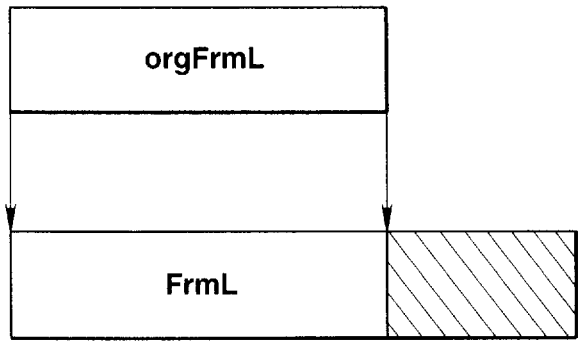
FIG. 13 illustrates an operation where the frame length is varied to reduce the speed of the decoding unit.

If the speed spd>1.0, that is, if the playback speed is slower than the original signal, the original frame is used and is supplemented with noise components to complete the missing portion, as shown in FIG. 13. A decoded excitation vector added to a suitably generated noise signal may supplement the frame. Alternatively, Gaussian noise may be generated and used as the excitation vector to reduce the unnatural feeling produced by a continuation of all frames with the same waveform. Noise components may also be added to both ends of the original frame.

Thus, in the case of the speech signal reproducing apparatus 1 configured to change the playback speed by varying the frame length, the speech synthesis unit 6 is constructed and designed so that the LSP interpolation units 232*v* and 232*u*, sinusoidal synthesis unit 215, and the windowing unit 223 perform different operations than where the system controlled the playback speed using time-axis compression/expansion.

The LSP interpolation unit $\mathbf{232}_v$ finds the smallest integer p satisfying the relation frmL/p≦20 if the subject frame is voiced (V). The LSP interpolation unit $\mathbf{232}_u$ finds the smallest integer p satisfying the relation frmL/p≦80 if the frame in subject is unvoiced (UV). The range of the sub-frame subl[i][j] for LSP interpolation is determined by the following equation:

$$i\ \mathrm{nint}(frmL/p\times i)\leqq j\leqq nint(frmL/p\times(i+1),\ \text{where } 0\leqq i\leqq p-1.$$

In the above equation, nint(x) is a function that returns an integer closest to x by rounding the first sub-decimal order. For voiced signals, p=1 if frmL is less than 20. For unvoiced signals, p=1 if frmL is less than 80.

For example, for the ith sub-frame, since the center of the sub-frame is frmL×(2i+1)/2p, LSPs are interpolated at a rate of frmL×(2p−2i−1)/(20:frmL×(2i+1)/2p, as disclosed in Japanese Patent Application No. 6-198451.

Alternatively, the number of the sub-frames may be fixed and the LSPs of each sub-frame may be interpolated at all times at the same ratio. The sinusoidal synthesis unit 223 modifies the window length to match the frame length frmL.

Figure 14:
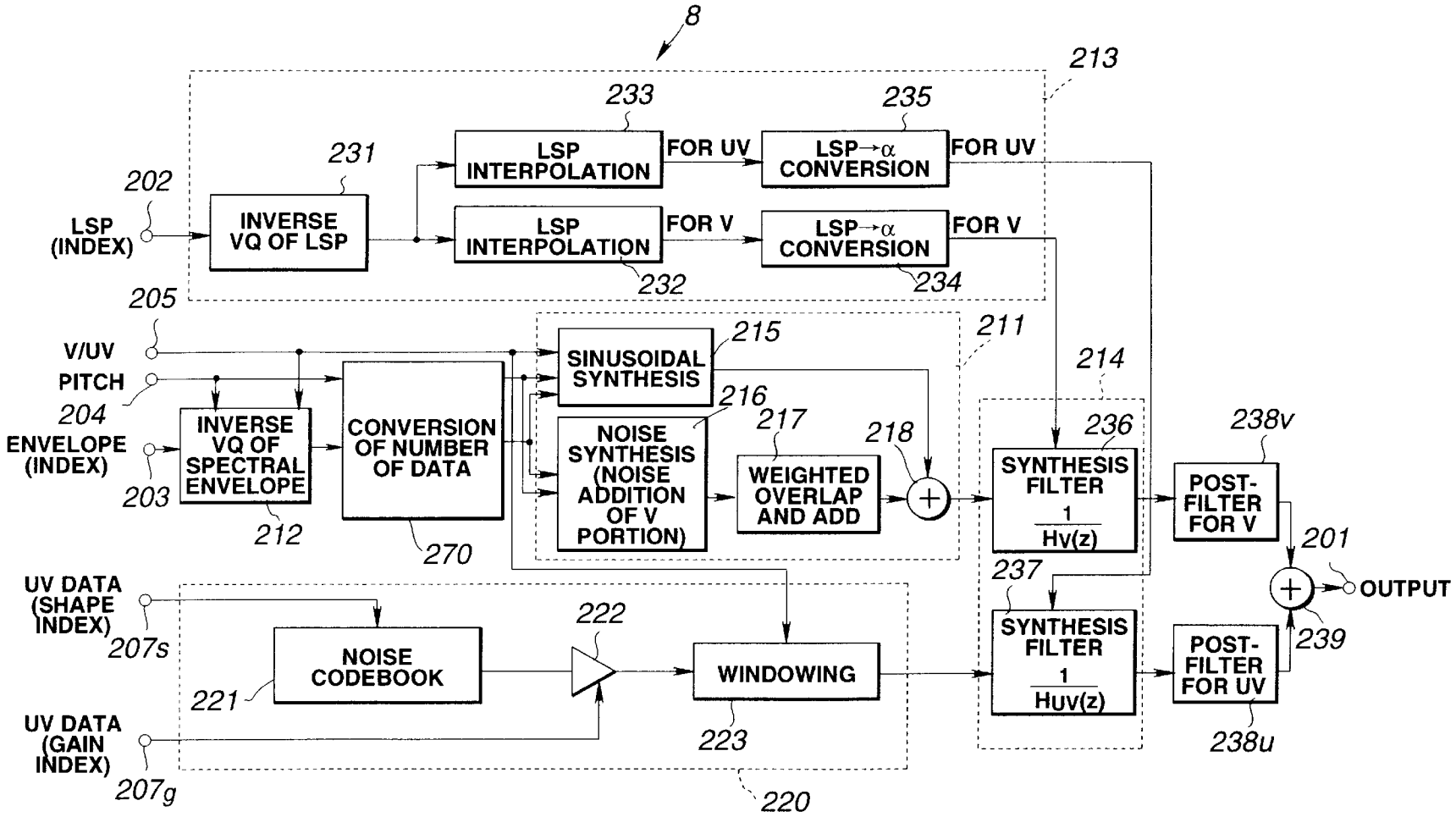
FIG. 14 is a block diagram showing another detailed structure of the decoding unit.

In the above-described speech signal reproducing apparatus 1, the encoded parameters, the output period of which has been companded on the time axis, are modified using the period changing unit 3 and the parameter changing unit 5 to vary the reproducing speed without changing the pitch or phoneme of the signal. It is also possible, however, to omit the period changing unit 3 and process the encoded data from the encoding unit 2 using the conversion unit 270 of the decoding unit 8 shown in FIG. 14. In FIG. 14, the parts and components corresponding to those shown in FIG. 4 are indicated by the same reference numerals.

The basic concept underlying the decoding unit 8 is to convert the basic frequency of the harmonics of the encoded speech data received from the encoding unit 2 and the number of amplitude data points in a pre-set band using the number of data conversion unit 270 to change only the pitch without changing the phoneme. The data conversion unit 270 varies the pitch by modifying the number of data points specifying the size of spectral components in each of the input harmonics.

Referring to FIG. 14, vector quantized output LSPs, from output terminal 102 of FIGS. 2 and 3, or codebook indices, are supplied to input terminal 202.

The LSP index data is sent to an inverse vector quantizer 231 of the LPC parameter reproducing unit 213 for inverse vector quantization into line spectrum pairs (LSPs). The LSPs are sent to LSP interpolation circuits 232, 233 for interpolation and then to the LSP-to-α conversion circuits 234, 235 for conversion to α-parameters. These α-parameters are sent to the LPC synthesis filter 214. The LSP interpolation circuit 232 and the LSP-to-α converting circuit 234 are used for the voiced (V) signal portion, while the LSP interpolation circuit 233 and the LSP-to-α converting circuit 235 are used for the unvoiced (UV) signal portion. The LPC synthesis filter 214 is made up of an LPC synthesis filter 236 for the voiced portion and an LPC synthesis filter 237 for the unvoiced portion. The LPC coefficient interpolation is performed independently for the voiced portion and the unvoiced portion to prevent the artifact produced by interpolation of LSPs of totally different character at a transient region from a voiced portion to an unvoiced portion appearing in the signal.

Input terminal 203 of FIG. 14 is supplied with weighted vector quantized code index data of the spectral envelope Am corresponding to the output at terminal 103 of the encoder shown in FIGS. 2 and 3. Input terminal 205 is supplied V/UV decision data from terminal 105 of FIGS. 2 and 3.

The vector quantized index data of the spectral envelope Am from the input terminal 203 is sent to the inverse vector quantizer 212 for inverse vector quantization. The number of amplitude data points of the inverse vector quantized envelope is fixed at a pre-set value of, for example, 44. Basically, the number of data points is converted to match the number of harmonics corresponding to the pitch data. If it is desired to change the pitch, as in the present embodiment, the envelope data from the inverse vector quantizer 212 is sent to the data conversion unit 270 to vary the number of amplitude data points by, for example, interpolation, depending on the desired pitch value.

The data conversion unit 270 is also fed with pitch data from input terminal 204 such that the pitch during the encoding time is changed to a desired pitch. The amplitude data and the modified pitch data are sent to the sinusoidal synthesis circuit 215 of the voiced speech synthesis unit 211. The number of the amplitude data points supplied to the synthesis circuit 215 corresponds to the modified pitch of the spectral envelope of the LPC residuals from the data conversion unit 270.

There are a variety of interpolation methods for converting the number of amplitude data points of the spectral envelope of the LPC residuals by the data conversion unit 270. For example, a suitable number of dummy data points for interpolating amplitude data of an effective band block on the frequency axis may be added between the last amplitude data in the block and the first amplitude data in the block. Alternatively, dummy data extending the left-hand end (first data) and/or the right-hand end (last data) in the block, may be appended to make the number of data points equal to $N_F$. Then, an Os-tuple number of amplitude data points are found by band-limiting type Os-tuple over sampling, such as octatuple over sampling. The Os-tuple number of amplitude data points ((mMx+1)×Os number of data points) is further expanded to a larger number $N_M$, such as 2048, by linear interpolation. These $N_M$ data points are converted into a preset number of points M (such as 44) by decimation. Vector quantization is then carried out on the M data points.

To illustrate the operation of the data conversion unit 270, consider the case in which the fundamental frequency is $F_0=f_s/L$ for a pitch lag L frequency and where fs is a sampling frequency, such that fs=8 kHz=8000 Hz.

In this case, the pitch frequency $F_0$=8000/L, while there are n=L/2 harmonics up to 4000 Hz. In the usual speech range of 3400 Hz, the number of harmonics is (L/2)×(3400/4000). This is converted by the above data number conversion or dimensional conversion to, for example, 44, before proceeding to vector quantization. There is no necessity of performing quantization if only the pitch is to be varied.

After inverse vector quantization, the number of harmonics, now set at 44, can be changed to a desired number. That is, a desired pitch frequency Fx may be selected by dimensional conversion using the data conversion unit 270. The pitch lag Lx corresponding to the pitch frequency Fx(Hz) is Lx=8000/Fx, such that the number of harmonics up to 3400 Hz is (Lx/2)×(3400/4000)=(4000/Fx)×(3400/4000)=3400/Fx. The conversion from 44 harmonics to 3400/Fx harmonics is done by dimensional conversion in the data conversion unit 270.

If the frame-to-frame difference is found at the time of encoding prior to vector quantization of spectral data, the frame-to-frame difference is decoded after the inverse vector quantization. A number of data conversion is then performed to produce the spectral envelope data.

The sinusoidal synthesis circuit 215 is supplied not only with pitch data and spectral envelope amplitude data of LPC residuals from the data conversion unit 270 but also with the V/UV decision data from input terminal 205. From the sinusoidal synthesis circuit 215, the LPC residual data are taken out and sent to the adder 218.

The envelope data from the inverse vector quantizer 212, the pitch data from input terminal 204, and the V/UV decision data from input terminal 205 are sent to the noise addition circuit 216 for noise addition to the voiced (V) portion. Specifically, the noise is synthesized taking into account the parameters derived from the encoded speech data, such as pitch, spectral envelope amplitudes, and maximum amplitude in the frame or residual signal level. This noise is added to the voiced portion of the LPC residual signal for LPC synthesis filter input. Noise is added to the voiced speech signal because, if the input to the LPC synthesis filter of the voiced speech produced by sinusoidal synthesis is not mixed with synthesized noise, a "stuffed" feeling is produced in low-pitch sounds, such as male speech. In addition, the sound quality without noise will change abruptly between the V and UV speech portions, thus producing an unnatural feeling.

The output of the adder 218 is sent to the synthesis filter 236 for voiced speech where the time waveform data is produced by LPC synthesis. The resulting time waveform data is filtered by a post-filter 238*v* for voiced data and then supplied to an adder 239.

Input terminals 207*s* and 207*g* of FIG. 14 are supplied with shape index data and gain index data for the unvoiced portion (UV) from output terminals 107*s* and 107*g* of FIG. 3 via the period changing unit 3. The shape index data and the gain index data are then supplied to the unvoiced speech synthesis unit 220. The shape index data from terminal 207*s* and the gain index data from terminal 207*g* are supplied to the noise codebook 221 and the gain circuit 222 of the unvoiced speech synthesis unit 220, respectively. A representative value from the noise codebook 221, that is, the noise signal component corresponding to the LPC residuals of the unvoiced portion of the speech signal, becomes the amplitude of the gain in the gain circuit 222. The gain amplitude value is sent to the windowing circuit 223 for smoothing the junction between voiced and unvoiced signal portions.

The output of the windowing circuit 223, which is an output of the unvoiced speech synthesis unit 220, is sent to the synthesis filter 237 for the unvoiced (UV) portion of the LPC synthesis filter 214. The output of the windowing circuit 223 is processed by the synthesis filter 237 by LPC synthesis to give a time-domain waveform signal of the unvoiced speech signal portion. This signal is then filtered by a post-filter for the unvoiced speech portion 238*u* and then supplied to the adder 239.

The adder 239 sums the time-domain waveform signal for the voiced speech signal portion from the post-filter 238*v* for with the time-domain waveform data for the unvoiced speech signal portion from the post-filter for the unvoiced speech signal portion 238*u*. The resulting sum signal is output at output terminal 201.

As can be seen, the pitch can be varied without changing the phoneme of the speech by changing the number of harmonics but without changing the shape of the spectral envelope. Thus, if a speech pattern, such as an encoded bitstream, is available, its pitch may be varied.

Figure 15:
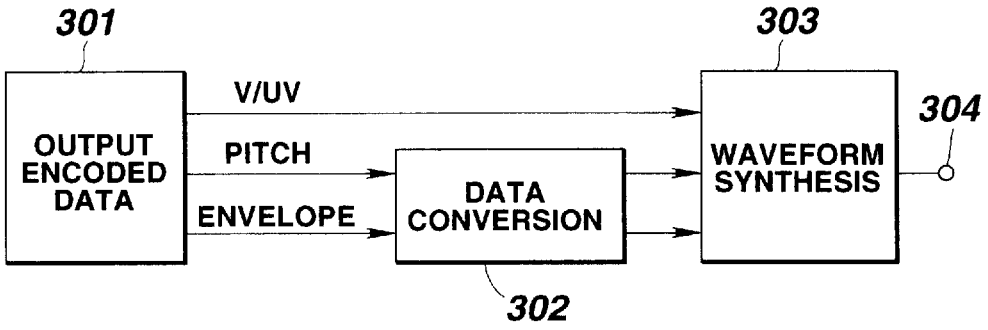
FIG. 15 is a block diagram showing an example of application of a speech synthesis device.

Referring to FIG. 15, an encoded bitstream or encoded data obtained by the encoder of FIGS. 2 and 3 is output from an encoded data outputting unit 301. Of these data, at least the pitch data and spectral envelope data are sent via a data conversion unit 302 to a waveform synthesis unit 303. The data irrelevant to pitch conversion, such as voiced/unvoiced (V/UV) decision data, are sent directly to the waveform synthesis unit 303.

The waveform synthesis unit 303 synthesizes the speech waveform based on the spectral envelope data and pitch data. Of course, in the case of the synthesis device shown in FIGS. 4 or 5, LSP data or CELP data are also supplied from the outputting unit 301 to the synthesis device.

In the configuration of FIG. 15, at least pitch data or spectral envelope data are converted by the data conversion unit 302 depending on the desired pitch as described above and then supplied to the waveform synthesis unit 303 where the speech waveform is synthesized from the converted data. Thus, speech signals that are changed in pitch but with unchanged phonemes are available at output terminal 304. The above-described technique can be used for synthesis of speech from text or from a solid-state memory.

Figure 16:
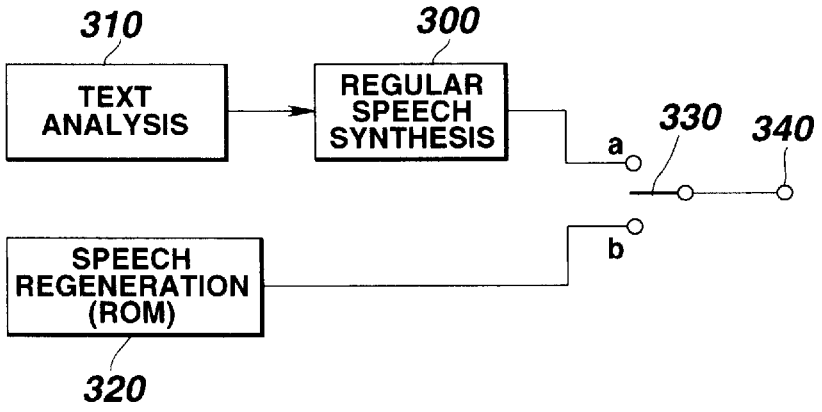
FIG. 16 is a block diagram showing an example of application of a text speech synthesis device.

FIG. 16 shows an example of an application of the present invention to speech text synthesis. In this embodiment, the above-described decoder for speech encoding for compression may be used as a text speech synthesizer.

In FIG. 16, the decoder 4 and the period changing unit 3 as described with reference to FIGS. 1, 4, and 5 comprise the regular speech synthesis unit 300. Data from a text analysis unit 310 is supplied to the regular speech synthesis unit 300. Synthesized speech having the desired pitch is sent to a fixed contact a of the changeover switch 330. Alternatively, the speech regenerating unit 320 reads out speech data that has been previously compressed and stored in a memory, such as a ROM and decodes that data. The decoded data is sent to the other fixed contact b of the changeover switch 330. One of the synthesized speech signal and the reproduced speech signal is selected by the changeover switch 330 and sent to output terminal 340.

The device shown in FIG. 16 may be used in, for example, a navigation system for a vehicle. Reproduced speech from the speech regenerator 320 may be used for routine messages, such as "Please turn to right". The synthesized speech from the regular speech synthesis unit 300 may be used for speech of non-standard messages, for example, pertaining to a particular geographic region. This type of data is more conveniently stored as text data.

The present invention has an additional advantage that the same hardware may be used for both the speech synthesizer 300 and the speech reproducing unit 320.

The present invention is not limited to the above-described embodiments. For example, the construction of the speech analysis device (encoder) of FIGS. 1 and 3 or the speech synthesis device (decoder) as described with reference to FIG. 14, described above as hardware, may also be realized as a software program utilizing a digital signal processor (DSP). The data of a plurality of frames may be collected and quantized by matrix quantization in place of vector quantization to provide a greater compression ratio.

The present invention may also be applied to a variety of speech analysis/synthesis applications and is not limited to transmission or recording/reproduction. This invention may be applied where pitch conversion, speed or rate conversion, synthesis of speech parameters stored in solid state memory or noise suppression are required.

Figure 17:
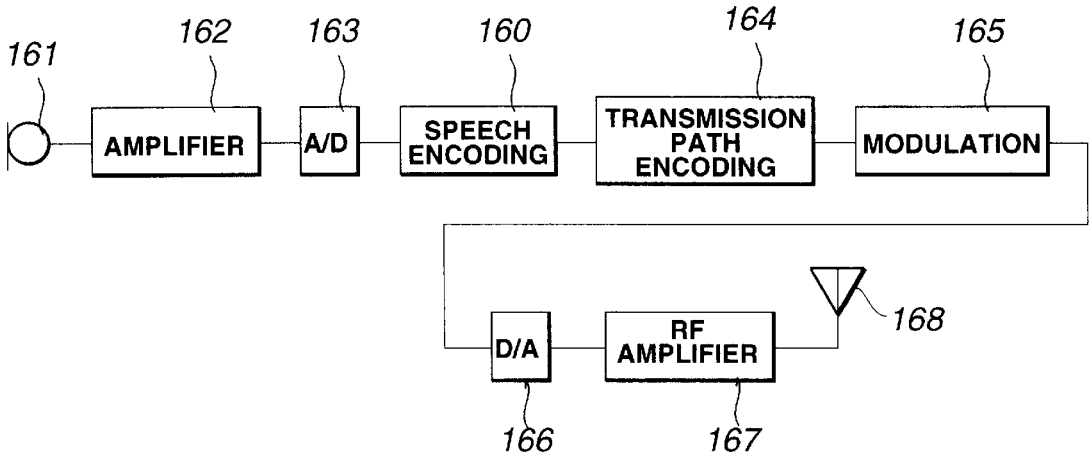
FIG. 17 is a block diagram showing the structure of a transmitter of a portable terminal employing the encoding unit.
Figure 18:
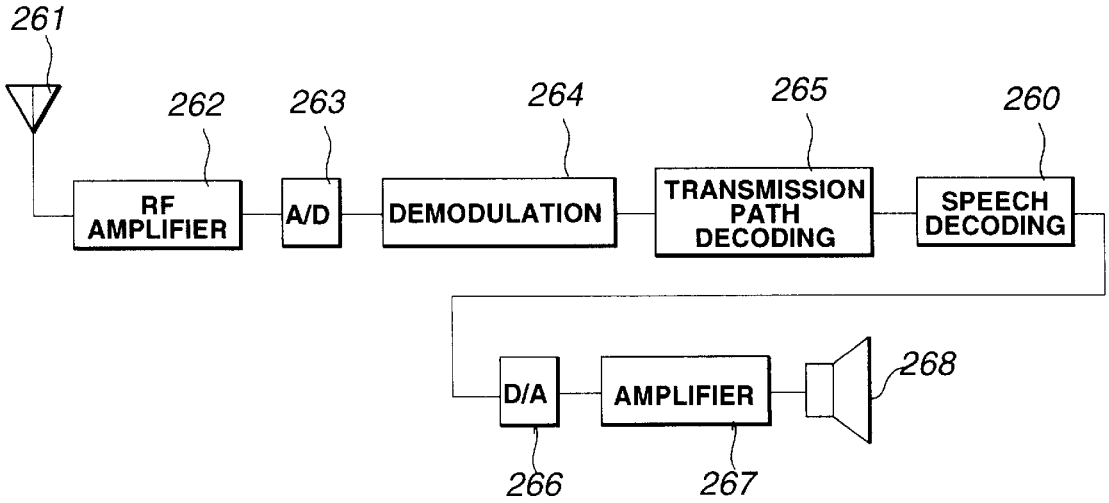
FIG. 18 is a block diagram showing the structure of a receiver of a portable terminal employing the decoding unit.

The above-described signal encoding and signal decoding apparatus may also be used as a speech codec employed in a portable communication terminal or a portable telephone set as shown in FIGS. 17 and 18.

FIG. 17 shows the transmitting side of a portable terminal employing a speech encoding unit 160 configured as shown in FIGS. 2 and 3. The speech signals collected by the microphone 161 are amplified by the amplifier 162 and converted by an analog/digital (A/D) converter 163 into digital signals. These digital signals are sent to the speech encoding unit 160 configured as shown in FIGS. 1 and 3. The speech encoding unit 160 performs encoding as explained in connection with FIGS. 1 and 3. Output signals from the speech encoding unit 160 are sent to the transmission path encoding unit 164 where channel coding is performed on the encoded speech signal. Output signals from the transmission path encoding unit 164 are sent to the modulation circuit 165 for modulation and are then supplied to the antenna 168 via the digital/analog (D/A) converter 166 and the RF amplifier 167.

FIG. 18 shows the reception side of the portable terminal employing the speech decoding unit 260 configured as shown in FIGS. 5 and 14. The speech signals received by the antenna 261 are amplified by the RF amplifier 262 and sent via the analog/digital (A/D) converter 263 to the demodulation circuit 264. Demodulated signals are sent to the transmission path decoding unit 265. The output signal of the decoding unit 265 is supplied to the speech decoding unit 260 configured as shown in FIGS. 5 or 14. The speech decoding unit 260 decodes the signals as explained in connection with FIGS. 5 or 14. The output signal of the speech decoding unit 260 is sent to the digital/analog (D/A) converter 266. The analog speech signal from the D/A converter 266 is sent to the speaker 268.

We claim:

1. A speech signal decoding method comprising the steps of:

receiving a value identifying a fundamental frequency of a speech signal at a first pitch;

receiving a set of amplitude values identifying a spectral envelope of said speech signal at said first pitch by defining amplitudes of a predetermined band of harmonics;

modifying said value identifying said fundamental frequency to form a modified fundamental frequency value;

interpolating additional amplitude values identifying a modified spectral envelope corresponding to said modified fundamental frequency value to form interpolated amplitude values; and synthesizing said speech signal at a second pitch based on said modified fundamental frequency value and said interpolated amplitude values.

2. The speech signal decoding method according to claim 1, wherein said step of interpolating is executed by a band-limited type oversampling.

3. A speech signal decoding apparatus comprising:

first receiving means for receiving a value identifying a fundamental frequency of a speech signal at a first pitch;

second receiving means for receiving a set of amplitude values identifying a spectral envelope of said speech signal at said first pitch by defining amplitudes of a predetermined band of harmonics;

modifying means connected to said first receiving means for modifying said value identifying said fundamental frequency and forming a modified fundamental frequency value;

interpolating means connected to said second receiving means for interpolating additional amplitude values identifying a modified spectral envelope corresponding to said modified fundamental frequency value to form an interpolated set of amplitude values; and synthesizing means connected to said interpolating means and to said modifying means for synthesizing said speech signal at a second pitch based on said modified fundamental frequency value and said interpolated set of amplitude values.

4. The speech signal decoding apparatus according to claim 3, wherein said interpolation means comprises a band-limited type oversampling filter.

5. A speech synthesis method comprising the steps of:

storing a value corresponding to a fundamental frequency of a speech signal at a first pitch;

storing a set of amplitude values of a predetermined band of harmonics corresponding to a spectral envelope of said speech signal at said first pitch;

retrieving said fundamental frequency value and said amplitude values;

modifying said fundamental frequency value to form a modified fundamental frequency value;

interpolating additional amplitude values corresponding to a modified spectral envelope based on said modified fundamental frequency value to form an interpolated set of amplitude values; and synthesizing said speech signal at a second pitch based on said modified fundamental frequency value and said interpolated set of amplitude values.

6. The speech synthesis method according to claim 5, wherein said step of interpolating is executed by a band-limited type oversampling.

7. A speech synthesis apparatus comprising:

storage means for storing a value corresponding to a fundamental frequency of a speech signal and amplitude values of a predetermined band of harmonics corresponding to a spectral envelope of said speech signal at a first pitch;

modifying means connected to said storage means for retrieving said fundamental frequency value and for modifying said fundamental frequency value to form a modified fundamental frequency value;

interpolating means connected to said storage means for retrieving said amplitude values and for interpolating additional amplitude values corresponding to a modified spectral envelope based on said modified fundamental frequency value to form an interpolated set of amplitude values; and synthesizing means connected to said modifying means and to said interpolating means for synthesizing said speech signal at a second pitch based on said modified Fundamental frequency value and said interpolated set of amplitude values.

8. The speech synthesis apparatus according to claim 7 wherein said interpolating means comprises a band-limited type oversampling filter.

9. A portable radio terminal apparatus comprising:

amplifier means for amplifying a received analog radio signal to form an amplified analog signal;

demodulation means connected to said amplifier means for demodulating said amplified analog signal to form a demodulated analog signal;

conversion means connected to said demodulation means for converting said demodulated analog signal to a digital signal;

transmission path decoding means connected to said conversion means for channel-decoding said digital signal to produce a speech encoded signal;

speech decoding means connected to said transmission path decoding means for decoding said speech encoded signal to produce a decoded speech signal; and D/A conversion means connected to said speech decoding means for converting said decoded speech signal to produce an analog output speech signal, wherein said speech decoding means includes:

first receiving means for receiving a first component of said encoded speech signal corresponding to a fundamental frequency value of said speech signal at a first pitch;

second receiving means for receiving a second component of said encoded speech signal corresponding to a set of amplitude values of a predetermined band of harmonics defining a spectral envelope of said speech signal at said first pitch;

modifying means connected to said first receiving means for modifying said first component corresponding to said fundamental frequency value to produce a modified fundamental frequency value;

interpolating means connected to said second receiving means and said modifying means for interpolating additional amplitude values corresponding to a modified spectral envelope based on said set of amplitude values and said modified fundamental frequency value to form an interpolated set of amplitude values; and synthesizing means connected to said interpolating means and to said modifying means for synthesizing said decoded speech signal at a second pitch based on said modified fundamental frequency value and said interpolated set of amplitude values.

* * * * *